US010808646B2

(12) United States Patent
Subramanya et al.

(10) Patent No.: US 10,808,646 B2
(45) Date of Patent: Oct. 20, 2020

(54) COOLED PISTON AND CYLINDER FOR COMPRESSORS AND ENGINES

(71) Applicant: Haier US Appliance Solutions, Inc., Wilmington, DE (US)

(72) Inventors: Praveena Alangar Subramanya, Karnataka (IN); Slawomir Pawel Bolek, Louisville, KY (US); Gregory William Hahn, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/243,134

(22) Filed: Jan. 9, 2019

(65) Prior Publication Data

US 2020/0217270 A1 Jul. 9, 2020

(51) Int. Cl.
*F02F 3/22* (2006.01)

(52) U.S. Cl.
CPC ..... *F02F 3/22* (2013.01)

(58) Field of Classification Search
CPC ..... F01B 29/10; F01P 3/00; F01P 2003/021; F01P 3/10; F01P 3/06
See application file for complete search history.

(56) References Cited

U.S. PATENT DOCUMENTS 4,027,993 A 6/1977 Wolff
4,573,880 A * 3/1986 Hirano ..... F04B 39/121 181/403
4,911,109 A * 3/1990 Kawamura ..... F01P 3/02 123/193.3
5,694,780 A 12/1997 Alsenz
5,769,610 A 6/1998 Marius
6,336,317 B1 1/2002 Holtzapple et al.
7,802,426 B2 9/2010 Bollinger
8,141,381 B2 3/2012 Ino et al.
8,801,399 B2 8/2014 Kim
2005/0271532 A1 12/2005 Chung et al.
2006/0140791 A1* 6/2006 Deming ..... F04C 18/3564 417/410.3
2008/0264062 A1 10/2008 Prueitt
(Continued)

FOREIGN PATENT DOCUMENTS

DE 102007000652 A1 5/2009
GB 2107427 A * 4/1983 ..... F02F 3/16
JP 2002061582 A 2/2002

*Primary Examiner* — Long T Tran
(74) *Attorney, Agent, or Firm* — Dority & Manning, P.A.

(57) ABSTRACT

Systems and compression assemblies thereof are provided. In one example aspect, a system includes a cooling fluid circuit and a piston slidably received within a chamber of a casing. The casing defines an inlet passage and an outlet passage. The inlet passage receives a cooling fluid, e.g. oil or a refrigerant, from the cooling fluid circuit. The cooling fluid flows into the inlet passage and downstream into an inlet groove defined by the piston along its outer surface. The cooling fluid flows downstream to a cooling channel defined by a piston head of the piston and thereafter into an outlet groove defined by piston along its outer surface. The cooling fluid then flows into outlet passage of casing and is returned to cooling fluid circuit. The passage of cooling fluid through the passages, grooves, and channels removes heat from the casing and the piston.

18 Claims, 16 Drawing Sheets

(56) References Cited

U.S. PATENT DOCUMENTS

| | | | | |
|---|---|---|---|---|
| 2009/0205338 | A1* | 8/2009 | Harmon, Sr. | F01K 15/02 60/677 |
| 2013/0167798 | A1* | 7/2013 | Lawler | F02B 71/04 123/193.4 |
| 2013/0333658 | A1* | 12/2013 | Yamamoto | F02F 1/10 123/195 R |
| 2015/0110647 | A1* | 4/2015 | Wilhelm | F04C 18/12 417/228 |
| 2015/0226200 | A1 | 8/2015 | Beers et al. | |
| 2015/0226210 | A1 | 8/2015 | Barito et al. | |
| 2015/0354553 | A1 | 12/2015 | Nagura et al. | |
| 2015/0377178 | A1* | 12/2015 | Bussieres | F02F 1/14 123/41.72 |
| 2016/0115948 | A1* | 4/2016 | Barito | F04B 35/045 417/415 |
| 2017/0002803 | A1 | 1/2017 | Van De Ven et al. | |
| 2017/0096991 | A1* | 4/2017 | Barito | F04B 53/18 |
| 2017/0211869 | A1 | 7/2017 | Barito et al. | |
| 2018/0045440 | A1 | 2/2018 | Hossain | |
| 2018/0179944 | A1* | 6/2018 | Endo | F01P 7/16 |

* cited by examiner

COOLED PISTON AND CYLINDER FOR COMPRESSORS AND ENGINES

FIELD OF THE INVENTION

The present subject matter relates generally to piston and cylinder arrangements having cooling features for compressors and reciprocating engines.

BACKGROUND OF THE INVENTION

Refrigerator appliances generally include a compressor. During operation of the refrigerator appliance, the compressor operates to provide compressed refrigerant. The refrigerator appliance utilizes such compressed refrigerant to cool a compartment of the appliance and food items located therein. Recently, linear compressors have been used to compress refrigerant in refrigerator appliances. Linear compressors can include a piston slidably received within a chamber of a cylinder. The piston is slid backward and forwards within the chamber to compress refrigerant. Valves positioned in a cylinder head of the cylinder may allow for ingress and egress of the refrigerant into and from the chamber.

At the end of a compression phase or stroke of the compression process, the cylinder and valve temperatures are typically near the discharge temperature of the compressed gaseous refrigerant. The direction of heat transfer may change during the compression process depending on the gas temperature inside the cylinder. For instance, when the gas temperature is lower than the temperature of the cylinder walls, heat flux is positive and heat is transferred from the cylinder walls to the gaseous refrigerant. When the gaseous refrigerant reaches the same temperature as the cylinder walls, heat flux is zero. When the gas temperature is greater than the temperature of the cylinder walls, heat flux is negative and heat is transferred from the gaseous refrigerant to the cylinder walls. The change in direction of heat transfer occurs not just during the compression phase, but also during the expansion phase or stroke of the compression process.

In some instances, the high discharge temperature of the gaseous refrigerant heats the cylinder walls and causes superheating of the gaseous refrigerant in the cylinder, resulting in a decrease in compressor efficiency. The magnitude of the decrease in compressor efficiency is mostly determined by the cylinder wall temperature. Moreover, many conventional compressors operate closely or as near as possible to isentropic compression. While operating the compressor close to isentropic compression prevents certain issues commonly associated with more efficient processes, e.g., wet compression, isentropic compression is not as efficient as other compression processes, such as e.g., isothermal compression. Accordingly, conventional compressors are typically not operated using compression processes that maximize compressor efficiency.

Accordingly, systems and compression assemblies thereof that address one or more of the challenges noted above would be useful.

BRIEF DESCRIPTION OF THE INVENTION

Aspects and advantages of the invention will be set forth in part in the following description, or may be apparent from the description, or may be learned through practice of the invention.

In one example embodiment, a system is provided. The system includes a cooling fluid circuit configured to receive a cooling fluid. The system also includes a compression assembly. The compression assembly includes a casing defining a chamber, an inlet passage, and an outlet passage, the inlet passage in fluid communication with the cooling fluid circuit and configured to receive the cooling fluid, the outlet passage in fluid communication with the cooling fluid circuit and configured to return the cooling fluid to the cooling fluid circuit. Further, the compression assembly includes a piston slidably received within the chamber of the casing, the piston having a piston head and an outer surface, the piston head defining a cooling channel and the piston defining an inlet groove and an outlet groove along the outer surface of the piston, wherein the inlet groove of the piston fluidly connects the inlet passage of the casing with the cooling channel of the piston, and wherein the outlet groove of the piston fluidly connects the cooling channel of the piston with the outlet passage of the casing.

In another example embodiment, a compression assembly defining an axial direction, a radial direction, and a circumferential direction is provided. The compression assembly includes a casing defining a chamber, an inlet passage, and an outlet passage, the inlet passage configured to receive a cooling fluid from a cooling fluid circuit and the outlet passage configured to return the cooling fluid to the cooling fluid circuit. Further, the compression assembly includes a piston slidably received within the chamber of the casing along the axial direction and movable between a top dead center position and a bottom dead center position to define a stroke of the piston, the piston having a piston head and an outer surface, the piston head defining a cooling channel, the piston defining an inlet groove extending longitudinally along the axial direction at the outer surface of the piston and an outlet groove extending longitudinally along the axial direction at the outer surface of the piston, the inlet groove spaced from the outlet groove along the circumferential direction. The inlet groove of the piston fluidly connects the inlet passage of the casing with the cooling channel of the piston through the stroke of the piston, and wherein the outlet groove of the piston fluidly connects the cooling channel of the piston with the outlet passage of the casing through the stroke of the piston.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
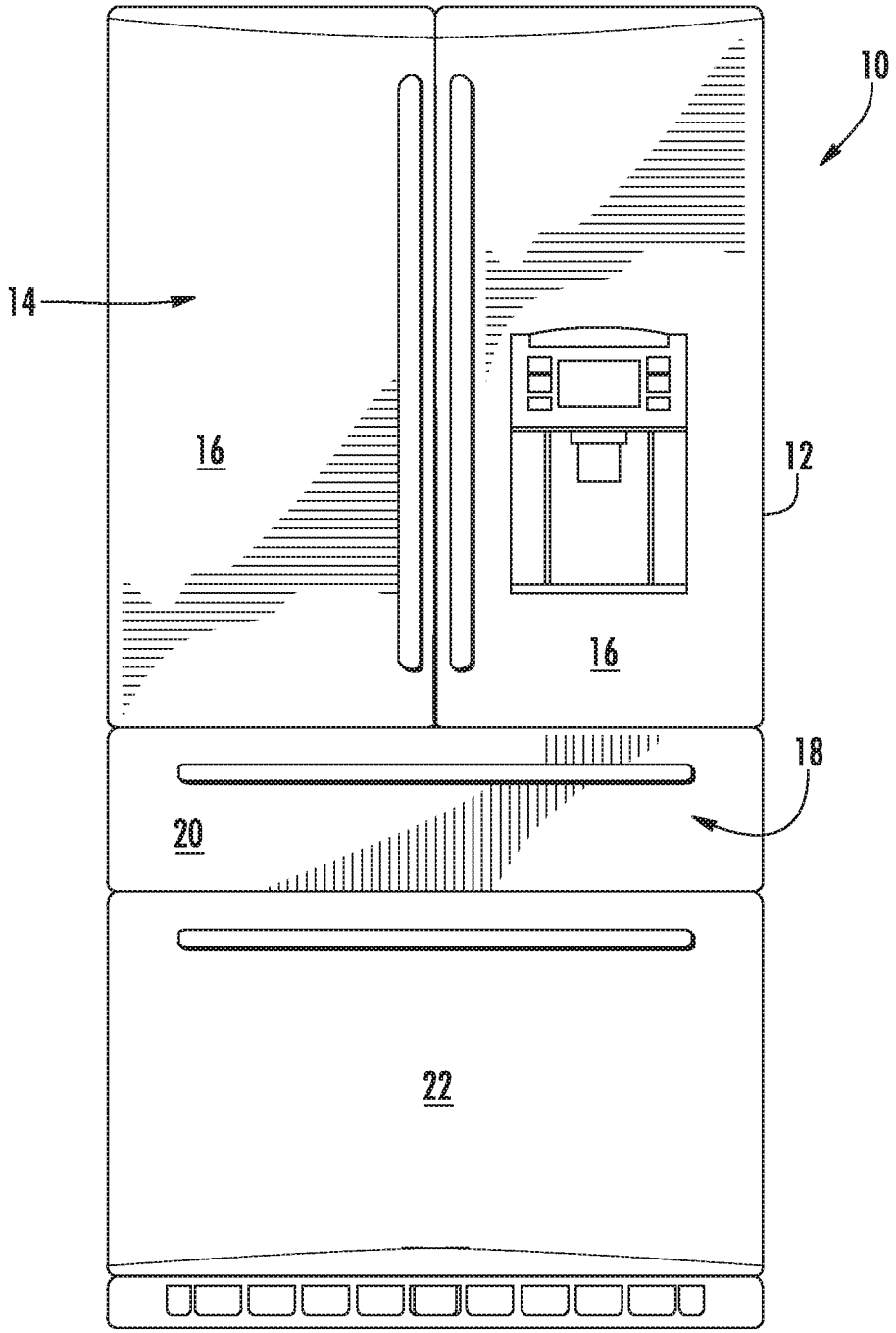
FIG. 1 provides a front view of a refrigerator appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "approximately," "substantially," or "about," refer to being within a ten percent (10%) margin of error of the stated value. Moreover, as used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Figure 2:
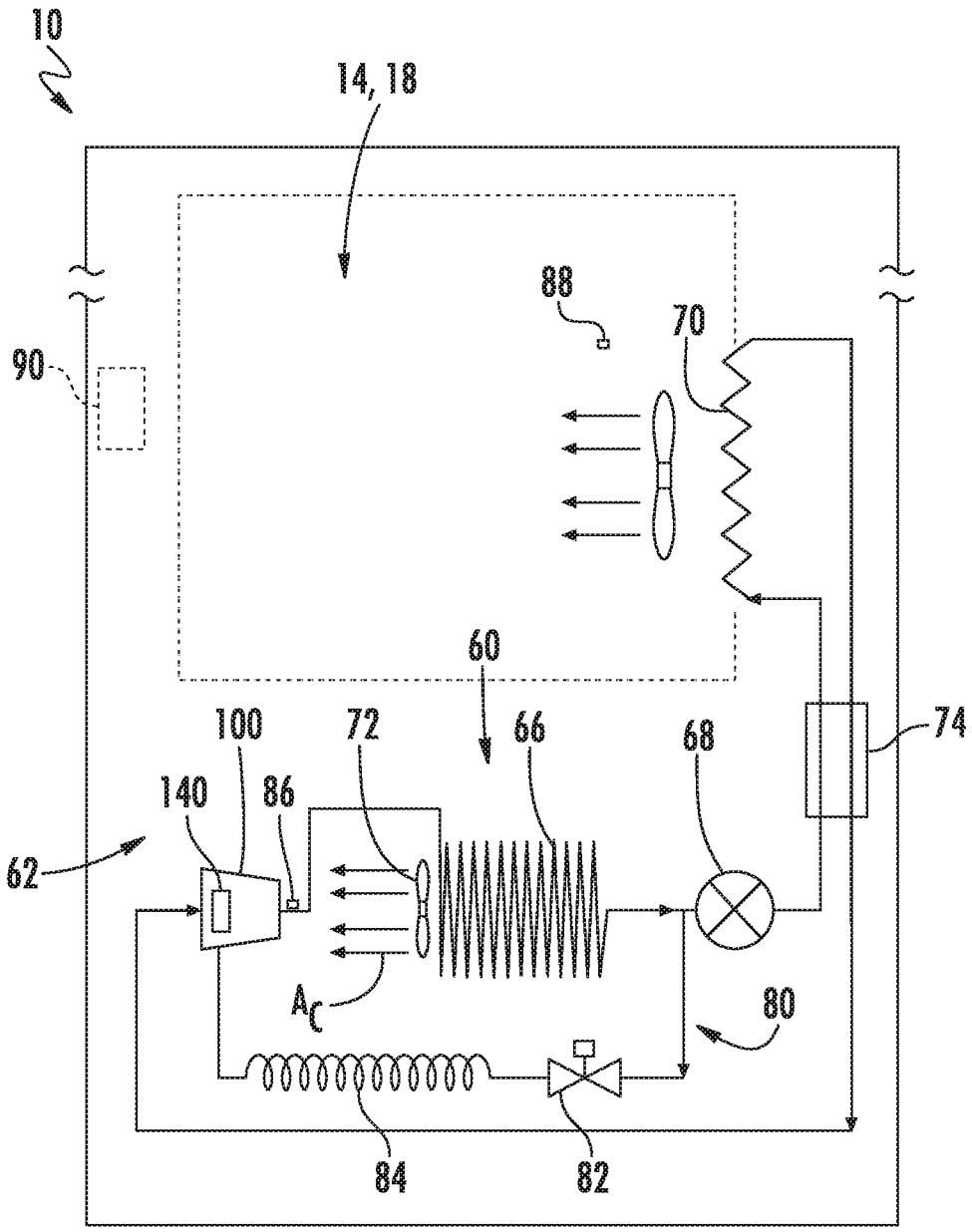
FIG. 2 provides a schematic view of a refrigeration system of the refrigerator appliance of FIG. 1.

FIG. 1 provides a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present subject matter is not limited to use in appliances. Thus, the present subject matter may be used for any other suitable purpose, such as vapor compression within air conditioners or heat pumps, air compressors, as well as to reciprocating engine applications.

In the illustrated example embodiment shown in FIG. 1, refrigerator appliance 10 is depicted as an upright refrigerator having a cabinet or casing 12 that defines a number of internal storage compartments. In particular, refrigerator appliance 10 includes upper fresh food compartments 14 having doors 16 and lower freezer compartment 18 having upper drawer 20 and lower drawer 22. The drawers 20, 22 may be "pull-out" drawers in that they can be manually moved into and out of the freezer compartment 18 on suitable slide mechanisms.

FIG. 2 provides a schematic view of refrigerator appliance 10 including an example system 60, which is a sealed refrigeration system in the depicted embodiment of FIG. 2. As shown, a machinery compartment 62 contains components for executing a vapor compression cycle for cooling air within refrigerator appliance 10. Sealed refrigeration system 60 includes a compression assembly, which is a linear compressor 100 in the depicted embodiment of FIG. 2. Sealed refrigeration system 60 also includes a condenser 66, an expansion device 68, and an evaporator 70 connected in series and charged with a refrigerant. For this embodiment, sealed refrigeration system 60 also includes a suction line heat exchanger (SLHX) 74. As will be understood by those skilled in the art, refrigeration system 60 may include additional components, e.g., at least one additional evaporator, compressor, expansion device, and/or condenser. As an example, refrigeration system 60 may include two evaporators.

Within refrigeration system 60, gaseous refrigerant flows into linear compressor 100, which operates to increase the pressure of the refrigerant. The compression of the refrigerant raises its temperature, which is lowered by passing the gaseous refrigerant through condenser 66. Within condenser 66, heat exchange with ambient air takes place so as to cool the refrigerant and cause the refrigerant to condense to a liquid state. A fan 72 is used to move air across condenser 66, as illustrated by arrows $A_C$, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device (e.g., a valve, capillary tube, or other restriction device) 68 receives liquid refrigerant from condenser 66. From expansion device 68, the liquid refrigerant enters evaporator 70. Upon exiting expansion device 68 and entering evaporator 70, the liquid refrigerant drops in pressure and temperature. Due to the pressure drop and phase change of the refrigerant, evaporator 70 is cool relative to compartments 14, 18 of refrigerator appliance 10. As such, cooled air is produced and refrigerates compartments 14, 18 of refrigerator appliance 10. Thus, evaporator 70 is a type of heat exchanger that transfers heat from air passing over evaporator 70 to refrigerant flowing through evaporator 70. SLHX 74 superheats the vapor in the gaseous refrigerant that has exited evaporator 70 and subcools the liquid refrigerant that has exited condenser 66.

As further depicted in FIG. 2, system 60 includes a cooling fluid circuit 80. A volume of cooling fluid (e.g., refrigerant) may be circulated along cooling fluid circuit 80 and downstream to a heat exchanger 140 of linear compressor 100. As will be explained in detail below, heat exchanger 140 of linear compressor 100 is operable to cool a cylinder and piston of linear compressor 100 to ultimately improve the performance of linear compressor 100 and to reduce the thermodynamic work required for compression of the gaseous refrigerant.

For this embodiment, an amount of liquid refrigerant from the vapor compression cycle may be diverted into cooling fluid circuit 80. Particularly, a volume of liquid refrigerant may be diverted into cooling fluid circuit 80 downstream of an outlet of condenser 66 and upstream of expansion device 68 as shown in FIG. 2. In some alternative embodiments, liquid refrigerant may be diverted into cooling fluid circuit 80 downstream of expansion device 68 and upstream of evaporator 70. A fluid control device 82 is positioned along cooling fluid circuit 80 and is operable to selectively control a flow rate of the cooling fluid (e.g., refrigerant) through cooling fluid circuit 80. For the depicted embodiment of FIG. 2, fluid control device 82 is a solenoid valve. However, in other embodiments, fluid control device 82 may be another suitable type of valve or device capable of selectively controlling the flow rate of the cooling fluid through cooling fluid circuit 80. As further shown in FIG. 2, a capillary tube 84 may optionally be positioned along cooling fluid circuit 80, e.g., for further metering the flow rate of the cooling fluid flowing through cooling fluid circuit 80. Thus, the flow rate of the cooling fluid (e.g., liquid refrigerant) diverted into cooling fluid circuit 80 may be controlled by fluid control device 82 and may be further metered by capillary tube 84 before flowing downstream to heat exchanger 140 of linear compressor 100 and eventually back through condenser 66.

Refrigerator appliance 10 includes various temperature sensors. For this embodiment, system 60 of refrigerator appliance 10 includes a temperature sensor 86 operable to sense an outlet temperature of the cooling fluid (e.g., the liquid refrigerant) at the outlet of linear compressor 100, or more particularly, at an outlet passage defined by a cylinder of linear compressor 100 as will be explained further below. Refrigerator appliance 10 also includes a compartment temperature sensor 88 operable to sense a temperature of the air within one or more chilled chambers of refrigerator appliance 10, e.g., fresh food and freezer compartments 14, 18. In some embodiments, refrigerator appliance 10 may include multiple compartment temperature sensors. For instance, refrigerator appliance 10 may include one or more compartment temperature sensors for sensing the air within fresh food compartment 14 and one or more compartment temperature sensors for sensing the air within freezer compartment 18. Temperature sensor 86 and compartment temperature sensor(s) 88 may be any suitable type of temperature sensors.

Refrigerator appliance 10 includes a controller 90. Controller 90 is communicatively coupled with various components of refrigerator appliance 10, including but not limited to, fluid control device 82, temperature sensor 86, compartment temperature sensor 88, fan 72 (or an electric motor thereof), expansion device 68, the fan of evaporator 70 (or an electric motor thereof), etc. Control signals generated in or by controller 90 operate refrigerator appliance 10, including various components of system 60, such as e.g., the components listed above. As used herein, controller 90 may refer to one or more microprocessors or semiconductor devices and is not restricted necessarily to a single element. The processing device can be programmed to operate refrigerator appliance 10. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Collectively, the vapor compression cycle components in a refrigeration circuit, associated fans, and associated compartments are sometimes referred to as a sealed refrigeration system operable to force cold air through refrigeration compartments 14, 18. The refrigeration system 60 depicted in FIG. 2 is provided by way of example only. Thus, it is within the scope of the present subject matter for other configurations of the refrigeration system to be used as well.

Figure 3:
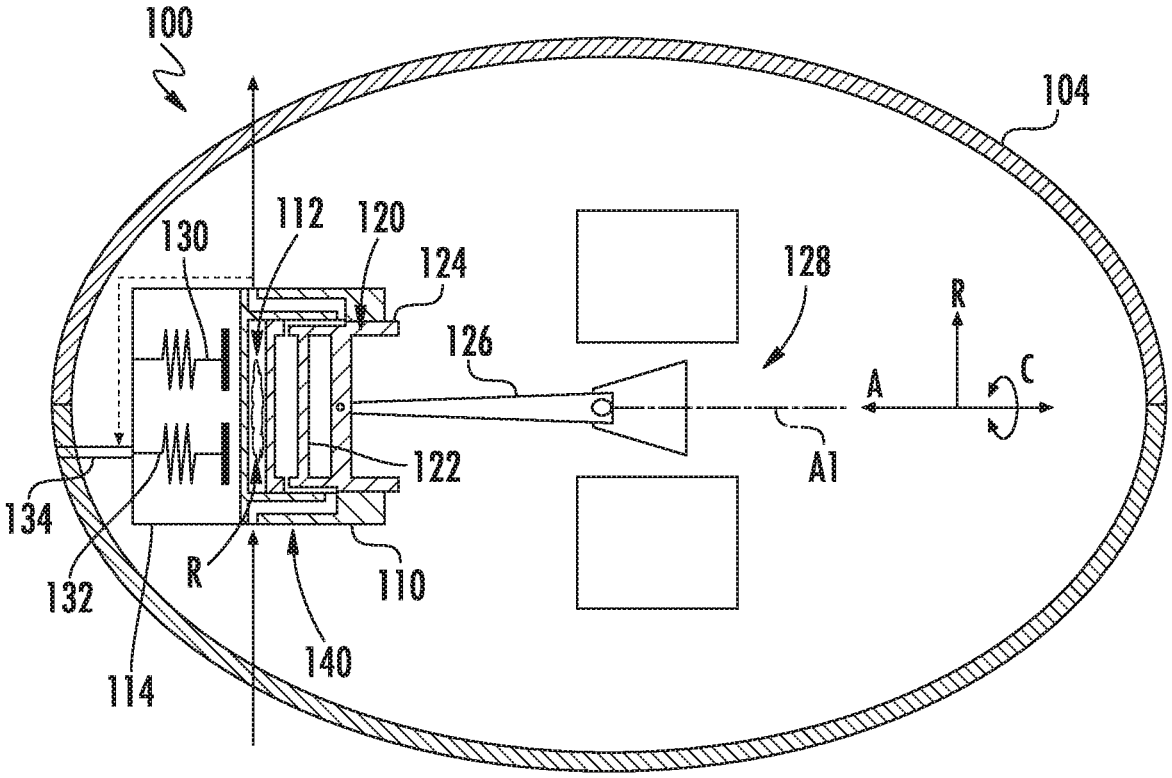
FIG. 3 provides a schematic view of a linear compressor according to an example embodiment of the present subject matter.

FIG. 3 provides a schematic view of linear compressor 100 according to an example embodiment of the present subject matter. As shown in FIG. 3, linear compressor 100 is enclosed in a hermetic or airtight shell 104. Hermetic shell 104 can, e.g., hinder or prevent refrigerant from leaking or escaping from refrigeration system 60 (FIG. 2) at linear compressor 100. Hermetic shell 104 may be a metal hermetic shell or may be constructed of or with any suitable type of metal, such as steel. Linear compressor 100 defines an axial direction A, a radial direction R, and a circumferential direction C that extends three hundred sixty degrees (360°) around the axial direction A.

Figure 4:
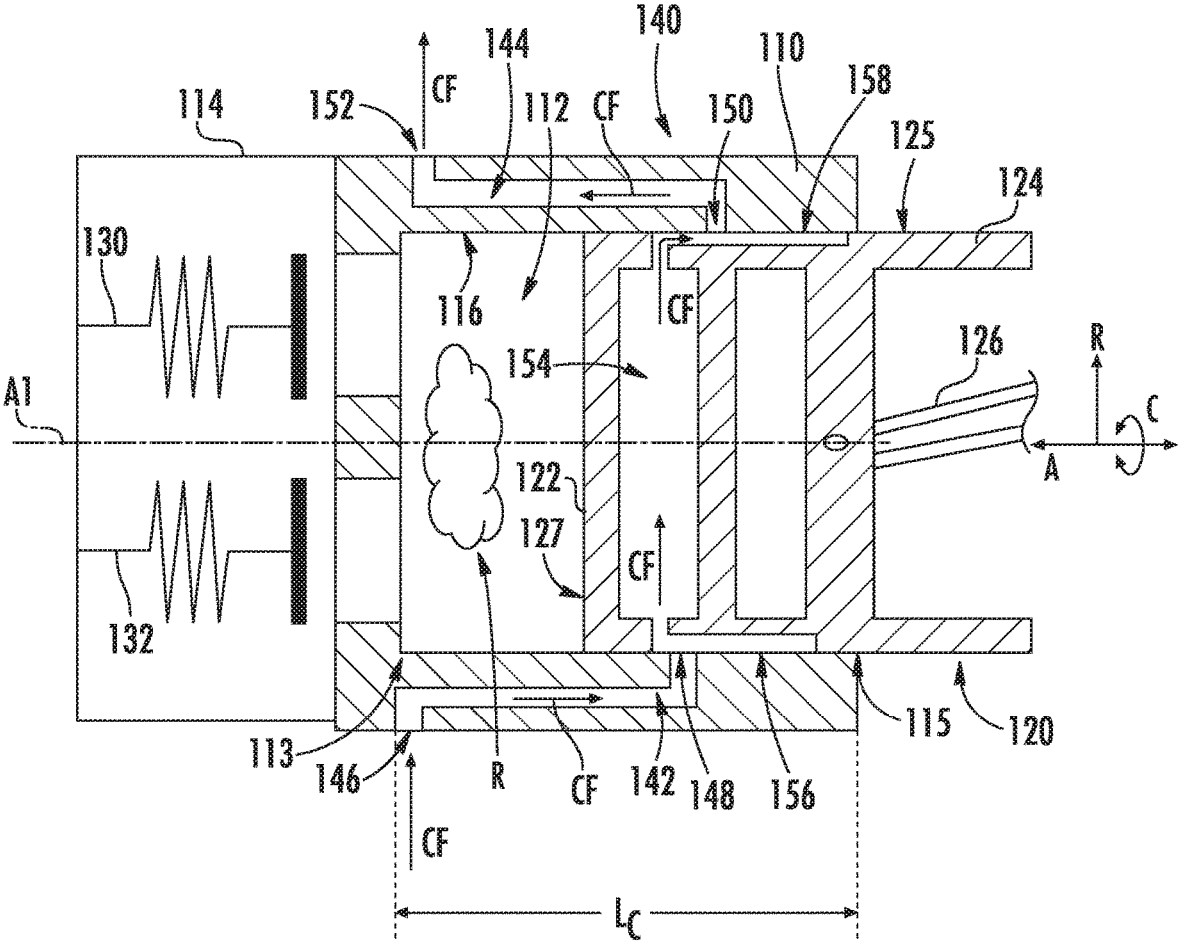
FIG. 4 provides a close up, schematic view of a piston slidably received within a chamber of a casing of the linear compressor of FIG. 3 and positioned in a top dead center position according to an example embodiment of the present subject matter.

Linear compressor 100 includes a cylinder or casing 110 enclosed within hermetic shell 104. Casing 110 defines a chamber 112 that extends longitudinally along the axial direction A. Casing 110 further includes valves that permit refrigerant (shown as "R") to enter and exit chamber 112 during compression of the refrigerant R by linear compressor 100. Linear compressor 100 further includes a piston 120 slidably received within chamber 112 of casing 110. In particular, piston 120 is movable or slidable along a first axis A1 between a top dead center position (FIG. 3) and a bottom dead center position (FIG. 4). The first axis A1 extends along the axial direction A. Piston 120 may assume a default position, e.g., when linear compressor 100 is not in operation. Piston 120 has a piston head 122 and a skirt 124 extending from piston head 122, e.g., longitudinally along the axial direction A. During sliding of piston 120 within chamber 112, piston 120 compresses refrigerant R within chamber 112.

Piston 120 is coupled with a drive assembly 128 via a connecting rod 126. Drive assembly 128 is operable to move or reciprocate piston 120 along the axial direction A within chamber 112. In some example embodiments, drive assembly 128 includes a motor (not shown) with at least one driving coil (not shown). The driving coil is configured for selectively urging piston 120 to slide along the axial direction A within chamber 112. In particular, the driving coil receives a current from a power supply (not shown) in order to generate a magnetic field that engages a magnet and urges piston 120 to move along the axial direction A in order to compress refrigerant R within chamber 112, as will be understood by those skilled in the art. In particular, the driving coil can slide piston 120 between the top dead center position and the bottom dead center position.

As an example, from the top dead center position, piston 120 can slide within chamber 112 towards the bottom dead center position along the axial direction A, i.e., an expansion stroke of piston 120. During the expansion stroke of piston 120, an intake/suction valve 130 permits refrigerant R to enter chamber 112. Intake/suction valve 130 is housed within a cylinder or casing head 114 of casing 110. When piston 120 reaches the bottom dead center position, piston 120 changes direction and slides in chamber 112 back towards the top dead center position, i.e., a compression stroke of piston 120. During the compression stroke of piston 120, refrigerant R that enters chamber 112 during the expansion stroke is compressed until refrigerant R reaches a particular pressure. The compressed refrigerant R, now at a higher pressure and temperature, exits chamber 112 through a discharge valve 132. In such a manner, refrigerant R is compressed within chamber 112 by piston 120. Discharge valve 132 is housed in casing head 114 adjacent intake/suction valve 130.

During operation of linear compressor 100, piston 120 reciprocates to compress refrigerant R, and the compressed refrigerant R flows out of chamber 112 through discharge valve 132. From discharge valve 132, the compressed refrigerant R is directed into a discharge conduit 134. Discharge conduit 134 extends between discharge valve 132 and hermetic shell 104 such that the compressed refrigerant R is flowable through discharge conduit 134 from discharge valve 132 to hermetic shell 104. Refrigerant R flowing downstream through discharge conduit 134 may be a liquid refrigerant and may flow downstream to condenser 66 (FIG. 2). Discharge conduit 134 may be plastic tubing suitable for use with a refrigerant. For example, discharge conduit 134 may be polytetrafluoroethylene plastic tubing, polyethylene plastic tubing, or nylon plastic tubing.

As further shown in FIG. 3, linear compressor 100 includes heat exchanger 140. Heat exchanger 140 is formed by various passages, grooves, and channels defined by casing 110 and piston 120 that are each configured to receive a cooling fluid, such as e.g., refrigerant from cooling fluid circuit 80, oil from a lubrication circuit, or some other suitable cooling fluid. For this embodiment, the cooling fluid CF is refrigerant R that is diverted from into cooling fluid circuit 80 as described above. Particularly, the cooling fluid CF circulated through cooling fluid circuit 80 (FIG. 2) flows through casing 110 and piston 120 to ultimately cool casing 110 and piston 120, which as noted above, may provide improved compressor performance and reduce the thermodynamic work required for compression of the gaseous refrigerant.

FIG. 4 provides a close up, schematic view of piston 120 slidably received within chamber 112 of casing 110 at the bottom dead center position according to an example embodiment of the present subject matter. Moreover, FIG. 4 depicts a close up view of heat exchanger 140. As shown, casing 110 defines an inlet passage 142 in fluid communication with the cooling fluid circuit 80. Inlet passage 142 extends between an inlet 146 and an outlet 148. Inlet 146 of inlet passage 142 is in fluid communication with cooling fluid circuit 80 (FIG. 2). Notably, outlet 148 of inlet passage 142 is defined at an inner surface 116 of casing 110 that at least partially defines chamber 112. Casing 110 also defines an outlet passage 144 in fluid communication with the cooling fluid circuit 80. Outlet passage 144 extends between an inlet 150 and an outlet 152. As depicted, inlet 150 of outlet passage 144 is defined at inner surface 116 of casing 110 that at least partially defines chamber 112. Outlet 152 of outlet passage 144 is in fluid communication with cooling fluid circuit 80 (FIG. 3).

Further, piston 120 defines a cooling channel 154, an inlet groove 156, and an outlet groove 158. More particularly, piston head 122 defines cooling channel 154 and inlet groove 156 and outlet groove 158 are defined by piston 120 along an outer surface 125 of piston 120. Inlet groove 156 and outlet groove 158 are spaced from one another, e.g., along the circumferential direction C, and both extend longitudinally along the axial direction A. Inlet groove 156 is defined axially along at least a portion of piston head 122 and along at least a portion of skirt 124 at outer surface 125 of piston 120. Similarly, outlet groove 158 is defined axially along at least a portion of piston head 122 and along at least a portion of skirt 124 at outer surface 125 of piston 120. Inlet groove 156 of piston 120 fluidly connects inlet passage 142 of casing 110 with cooling channel 154 of piston 120. Outlet groove 158 of piston 120 fluidly connects cooling channel 154 of piston 120 with outlet passage 144 of casing 110. Accordingly, the cooling fluid CF (e.g., refrigerant, oil, etc.) may flow through inlet passage 142 of casing 110 and into inlet groove 156 of skirt 124 of piston 120, through cooling channel 154 of piston head 122, along outlet groove 158 of skirt 124, and may flow out of heat exchanger 140 through outlet passage 144 of casing 110 where the cooling fluid CF may return to cooling fluid circuit 80 and flow downstream to condenser 66 (FIG. 2).

Notably, as shown in FIGS. 3 and 4, inlet groove 156 fluidly connects inlet passage 142 of casing 110 with cooling channel 154 at both the top dead center position (FIG. 3) and the bottom dead center position (FIG. 4). Moreover, outlet groove 158 fluidly connects cooling channel 154 with outlet passage 144 of casing 110 at both the top dead center position (FIG. 3) and the bottom dead center position (FIG. 4). Stated another way, outlet 148 of inlet passage 142 is axially and radially aligned with at least a portion of inlet groove 156 defined by piston 120 and inlet 150 of outlet passage 144 is axially and radially aligned with at least a portion of outlet groove 158 of piston 120 through the stroke of piston 120 between its top dead center and bottom dead center positions. In such a manner, a continuous flow of cooling fluid CF may circulate through heat exchanger 140, which may prevent or reduce sloshing of the cooling fluid CF as piston 120 reciprocates and may also provide enhanced cooling as cooling fluid CF may be continuously circulated through heat exchanger 140, among other benefits and advantages.

As further shown in FIG. 4, chamber 112 of casing 110 has an axial length $L_C$ that extends between a first end 113 and a second end 115 of chamber 112 along the axial direction A. As depicted, inlet passage 142 defined by casing 110 extends a distance along the axial direction A that is at least half of the axial length $L_C$ of chamber 112. In a similar manner, outlet passage 144 defined by casing 110 extends a distance along the axial direction A that is at least half of the axial length $L_C$ of chamber 112. In this manner, cooling fluid CF may provide enhanced cooling to casing 110 and may ultimately reduce the discharge temperature of the gaseous refrigerant. In some embodiments, inlet passage 142 extends axially at least from first end 113 of chamber 112 to an axial position that is further towards second end 115 of chamber 112 than a top or first surface 127 of piston head 122 of piston 120 along the axial direction A. In this way, cooling fluid CF passing through inlet passage 142 and outlet passage 144 may cool casing 110 along the entire axial length in which gaseous refrigerant may contact annular inner surface 116 of casing 110.

Figure 5:
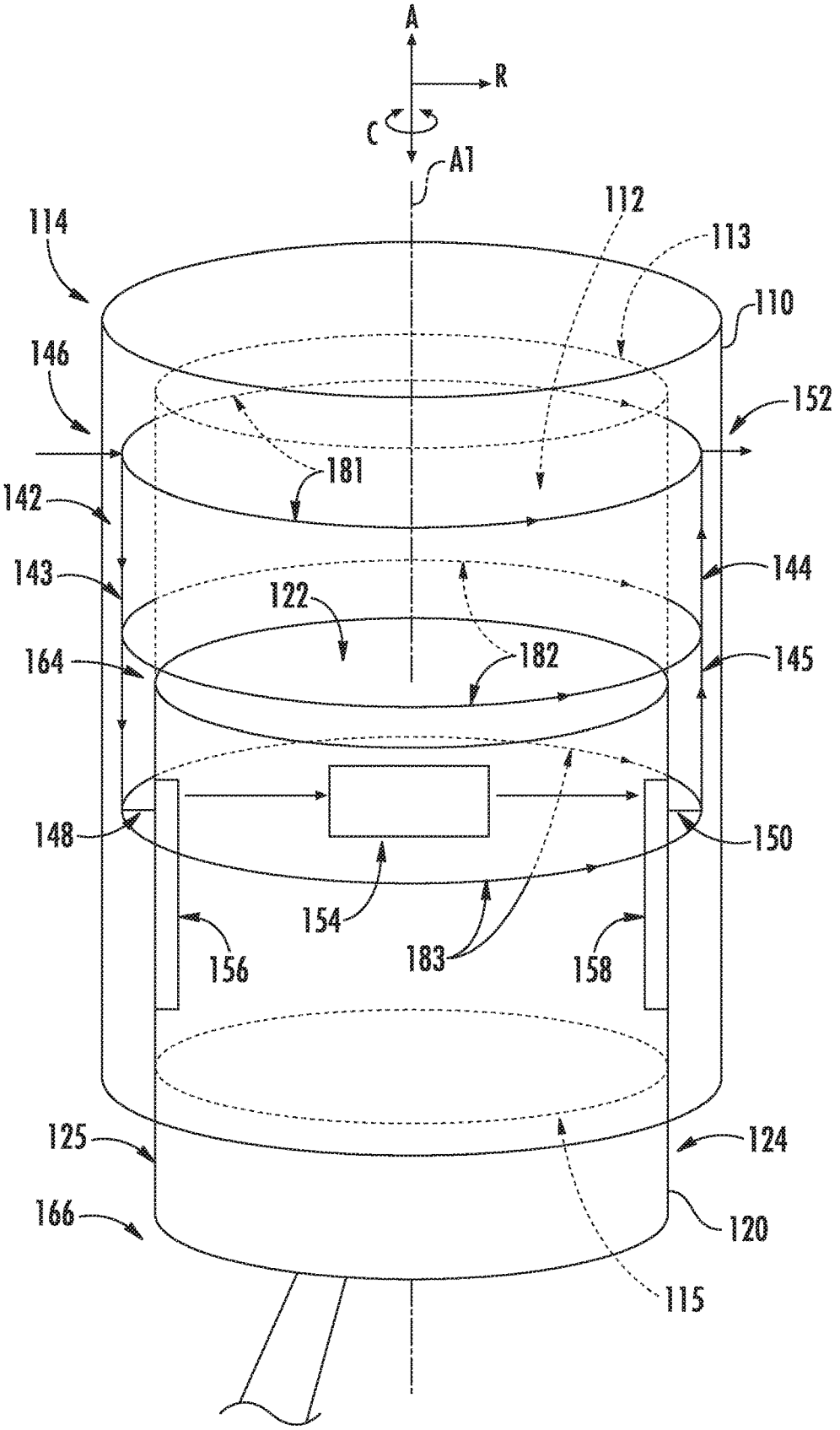
FIG. 5 provides a schematic view of the piston of FIG. 4 slidably received within the chamber and positioned in a bottom dead center position.

FIG. 5 provides a schematic view of piston 120 slidably received within chamber 112 of casing 110 and positioned in a bottom dead center position. As shown, for this embodiment, casing 110 defines one or more casing channels fluidly connecting inlet passage 142 of casing 110 with outlet passage 144 of casing 110. Particularly, casing 110 defines a first casing channel 181 extending annularly around chamber 112 and fluidly connecting inlet passage 142 with outlet passage 144, a second casing channel 182 extending annularly around chamber 112 and fluidly connecting inlet passage 142 with outlet passage 144, and a third casing channel 183 extending annularly around chamber 112 and fluidly connecting inlet passage 142 with outlet passage 144. Casing channels 181, 182, 182 are spaced from one another, e.g., along the axial direction A, and are fluidly connected to one another by an axial section 143 of inlet passage 142 that extends longitudinally along the axial direction A as well as by an axial section 145 of outlet passage 144 that extends longitudinally along the axial direction A. Generally casing channels 181, 182, 183 are configured to receive cooling fluid CF and thus casing channels 181, 182, 183 provide cooling circumferentially around chamber 112, e.g. at various axial positions as shown in FIG. 5. Although three (3) casing channels are depicted in FIG. 5, it will be appreciated that casing 110 may define more or less than three (3) casing channels 181, 182, 183.

Further in some embodiments, casing 110 may define one or more axial casing channels that extend axially between one or more casing channels. For instance, a first axial casing channel may extend axially between and fluidly connect first casing channel 181, second casing channel 182, and third casing channel 183. Further, a second first axial casing channel may extend axially between and fluidly connect first casing channel 181, second casing channel 182, and third casing channel 183, and may be positioned radially opposite the first casing channel 181 (i.e., the first axial casing channel may be spaced one hundred eighty degrees (180°) from the second axial casing channel). In such embodiments, the first axial casing channel may be spaced circumferentially from inlet passage 142 by ninety degrees (90°), and consequently, the second axial casing channel may be spaced circumferentially from outlet passage 144 by ninety degrees (90°). Moreover, in some embodiments, casing 110 may define a single annular casing channel that extends three hundred sixty degrees (360°) around chamber 112. In such embodiments, inlet passage 142 includes inlet 146 and outlet 148 but the axial portion of inlet passage 142 may be integrated with the annular casing channel. Likewise, outlet passage 144 includes inlet 150 and outlet 152 but the axial portion of outlet passage 144 may be integrated with the annular casing channel.

In addition, in some alternative embodiments, casing 110 defines inlet passage 142 and outlet passage 144 as a radial hole through casing 110. In such embodiments, casing 110 defines inlet passage 142 and outlet passage 144 without an axial section that extends longitudinally along the axial direction A (e.g., without axial sections 143, 145). Further, in some embodiments, casing 110 need not define casing channels and may only include a cooling fluid ingress (e.g., a radial hole) and a cooling fluid egress from piston 120.

Figure 6:
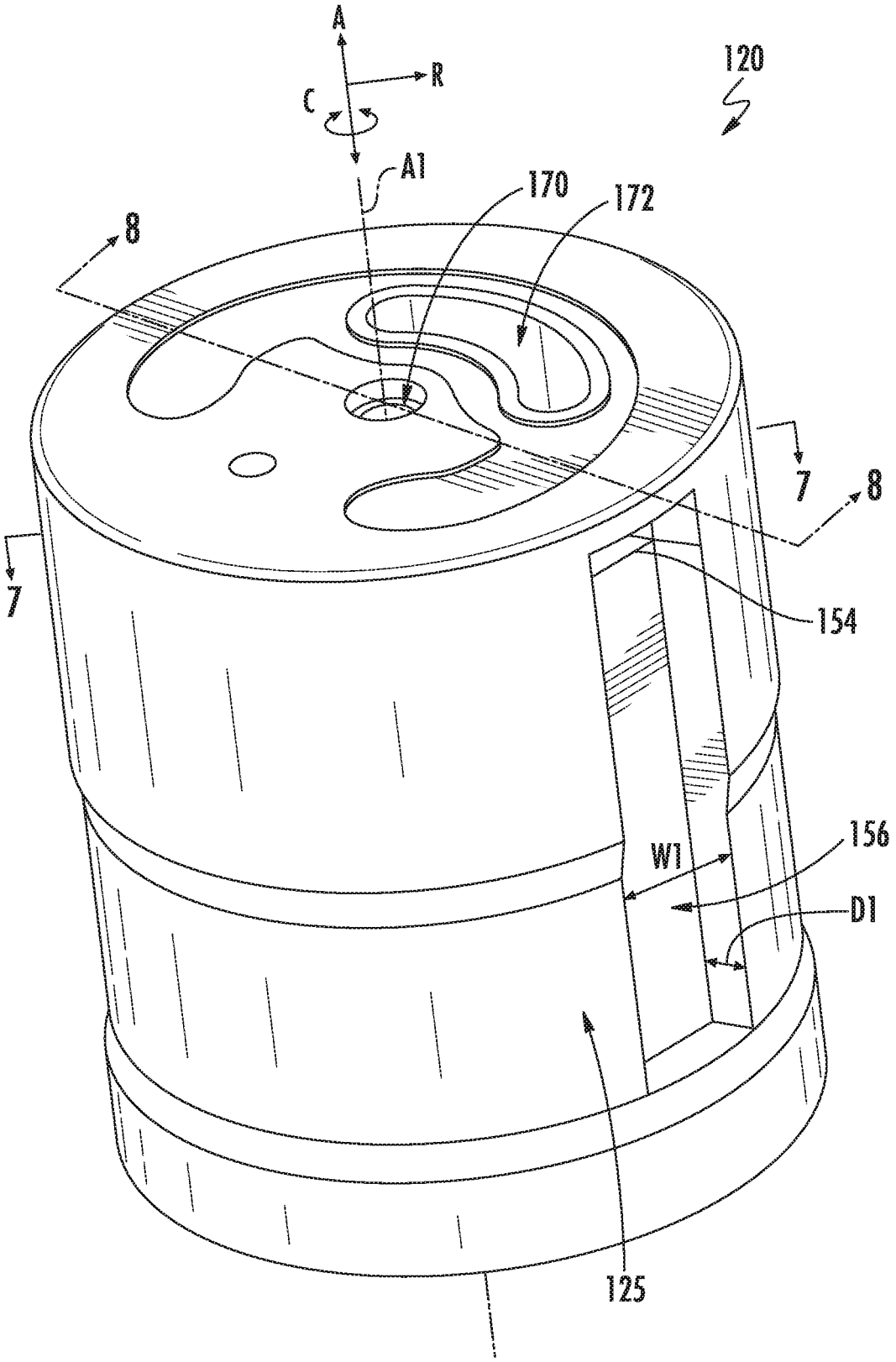
FIG. 6 provides a perspective view of an example piston according to an example embodiment of the present subject matter.
Figure 7:
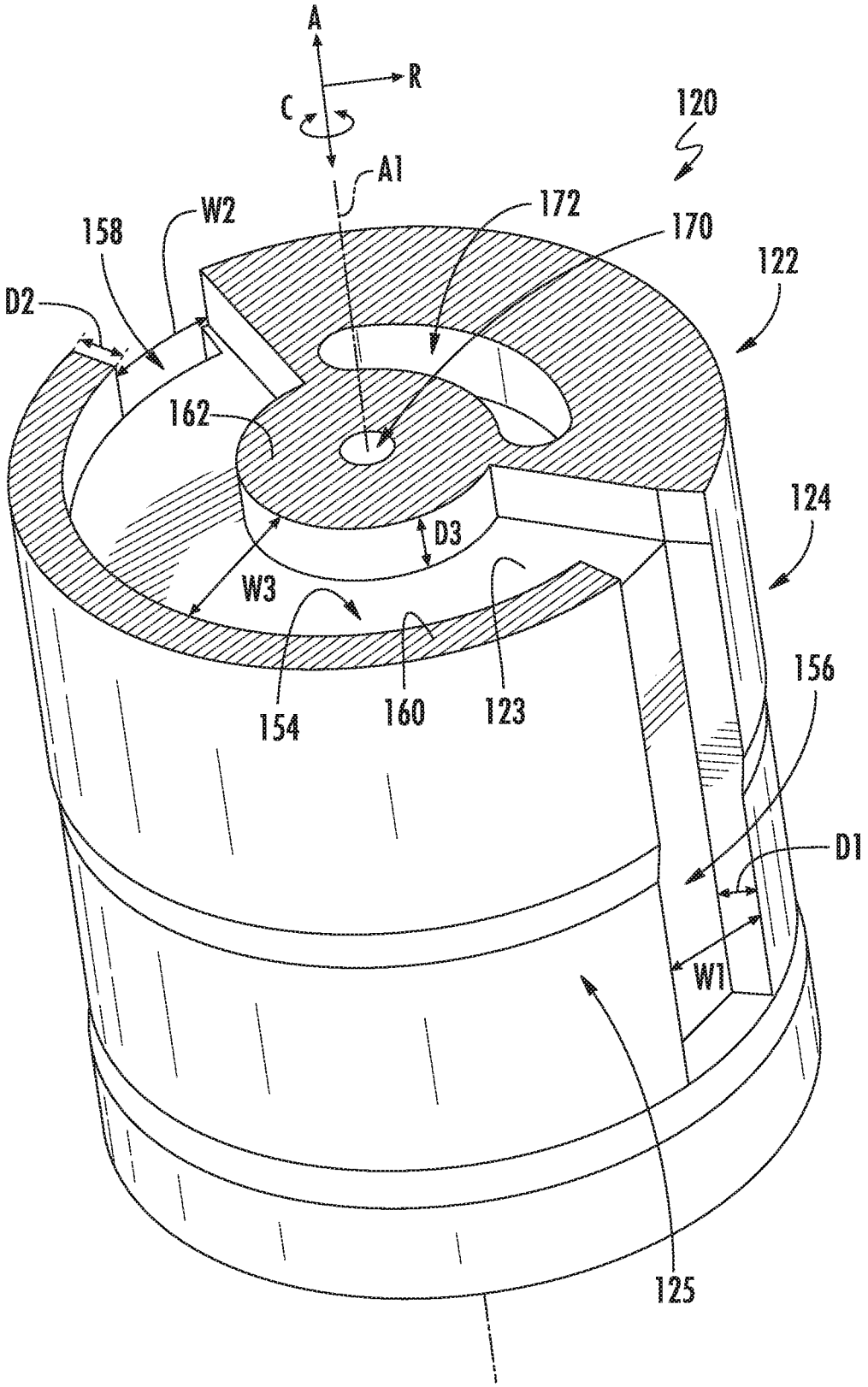
FIG. 7 provides a perspective, cross-sectional view of the piston of FIG. 6 taken along line 7-7 of FIG. 6.
Figure 8:
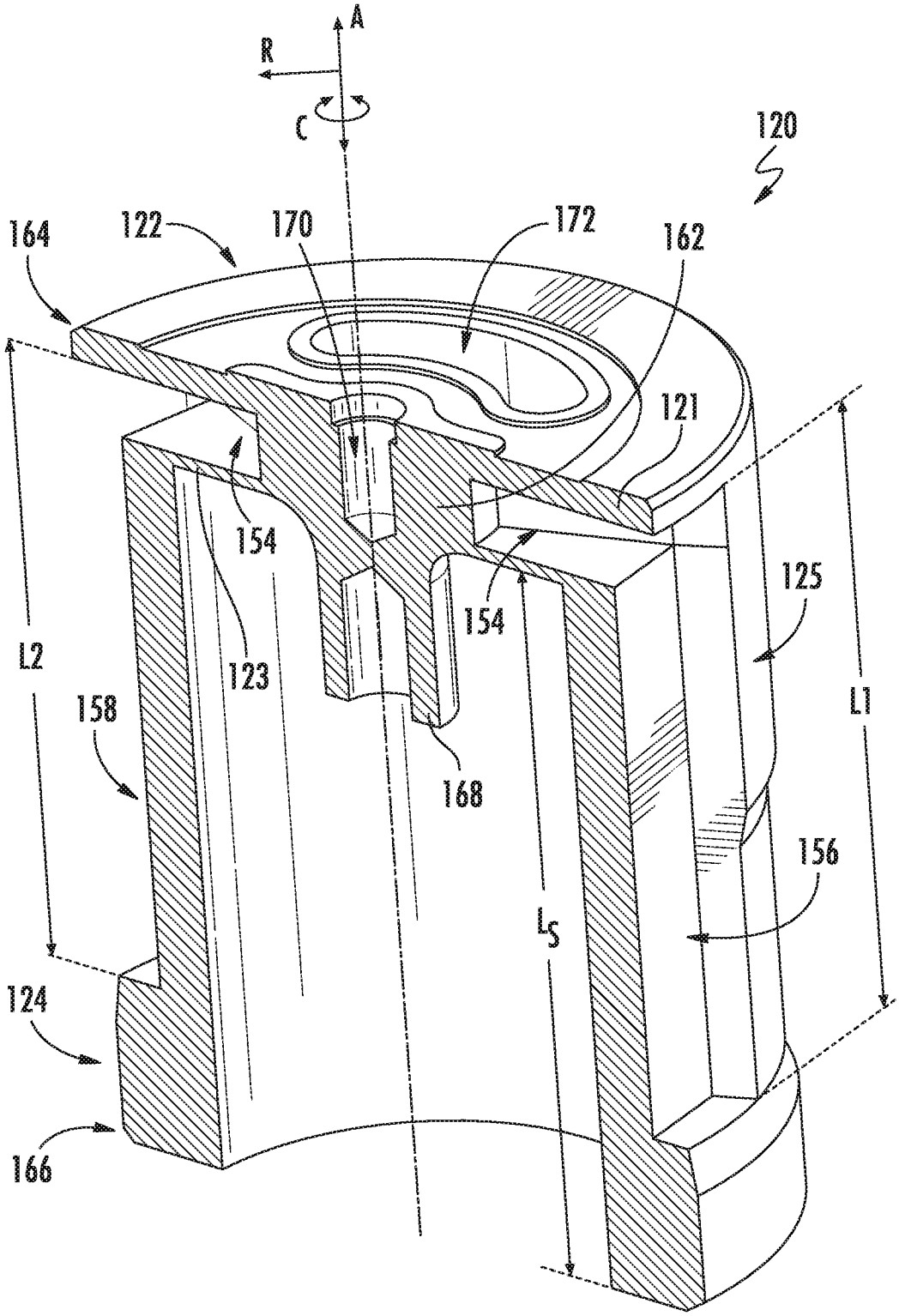
FIG. 8 provides a perspective, cross-sectional view of the piston of FIG. 6 taken along line 8-8 of FIG. 6.

FIGS. 6, 7, and 8 provide various views of piston 120 according to an example embodiment of the present subject matter. In particular, FIG. 6 provides a perspective view of piston 120, FIG. 7 provides a perspective, cross-sectional view of piston 120 depicting piston 120 sectioned along line 7-7 of FIG. 6, and FIG. 8 provides a perspective, cross-sectional view of piston 120 depicting piston 120 sectioned along line 8-8 of FIG. 6.

As shown, inlet groove 156 is defined along outer surface 125 of piston 120. Inlet groove 156 has a groove width W1, a groove length L1 (FIG. 8), and a groove depth D1. The groove width W1 of inlet groove 156 extends along the circumferential direction C, the groove length L1 of inlet groove 156 extends along the axial direction A, and the groove depth D1 extends along the radial direction R. Generally, inlet groove 156 extends longitudinally along the axial direction A and is recessed or undercut into outer surface 125 of piston 120. Inlet groove 156 extends axially along at least a portion of piston head 122 and along at least a portion of skirt 124 at outer surface 125 of piston 120.

Outlet groove 158 is configured in a similar manner as inlet groove 156. That is, outlet groove 158 is defined along outer surface 125 of piston 120. Outlet groove 158 has a groove width W2 (FIG. 7), a groove length L2 (FIG. 8), and a groove depth D2 (FIG. 7). The groove width W2 of outlet groove 158 extends along the circumferential direction C, the groove length L2 of outlet groove 158 extends along the axial direction A, and the groove depth D2 extends along the radial direction R. Further, as shown, inlet groove 156 and outlet groove 158 are spaced from one another along the circumferential direction C.

Generally, outlet groove 158 extends longitudinally along the axial direction A and is recessed or undercut into outer surface 125 of piston 120. Inlet groove 156 extends axially along at least a portion of piston head 122 and along at least a portion of skirt 124 at outer surface 125 of piston 120. As shown best in FIG. 8, piston 120 extends between a first end 164 and a second end 166 along the axial direction A. Skirt 124 of piston 120 has an axial length $L_S$ that extends between a bottom surface of second wall 123 and bottom end 166 of piston 120. Inlet groove 156 and outlet groove 158 extend along the axial direction A at least half the axial length $L_S$ of skirt 124. In this manner, outlet 148 of inlet passage 142 may be fluidly connected to inlet groove 156 of piston 120 no matter the axial position of piston 120 within chamber 112 and inlet 150 of outlet passage 144 may be fluidly connected to outlet groove 158 of piston 120 no matter the axial position of piston 120 within chamber 112.

As shown best in FIGS. 7 and 8, inlet groove 156 is fluidly connected with cooling channel 154, e.g., at an inlet of cooling channel 154, and outlet groove 158 is fluidly connected with cooling channel 154, e.g., at an outlet of cooling channel 154. Generally, cooling channel 154 is defined by piston head 122. More particularly, cooling channel 154 is defined between a first wall 121 (FIG. 8) and a second wall 123 of piston head 122, e.g., along the axial direction A. First wall 121 is spaced from second wall 123, e.g., along the axial direction A. Cooling channel 154 has a width W3 that extends along the radial direction R between an outer wall 160 (FIG. 7) of piston 120 and a center hub 162. Center hub 162 has a coupling 168 (FIG. 8) extending axially toward second end 166 of piston 120 and defines a counter bore 170 extending longitudinally along the axial direction A. Coupling 168 is configured for receiving connecting rod 126 (FIGS. 3 and 4). Piston head 122 of piston 120 also defines a suction port 172 extending therethrough along the axial direction A between first wall 121 and second wall 123.

Cooling channel 154 has a depth D3 that extends between first wall 121 and second wall 123 along the axial direction A. Cooling channel 154 extends between inlet groove 156 and outlet groove 158. For this embodiment, cooling channel 154 extends circumferentially around the first axis A1 to connect inlet and outlet grooves 156, 158. For the depicted embodiment of FIG. 7, cooling channel 154 of piston 120 extends along the circumferential direction C around the first axis A1 equal to or more than one hundred eighty degrees (180°). Cooling channel 154 extends generally radially opposite suction port 172 as shown in FIG. 7. In some embodiments, piston head 122 may not define a suction port and thus may define cooling channel 154 such that cooling channel 154 extends annularly around first axis A1.

Figure 9:
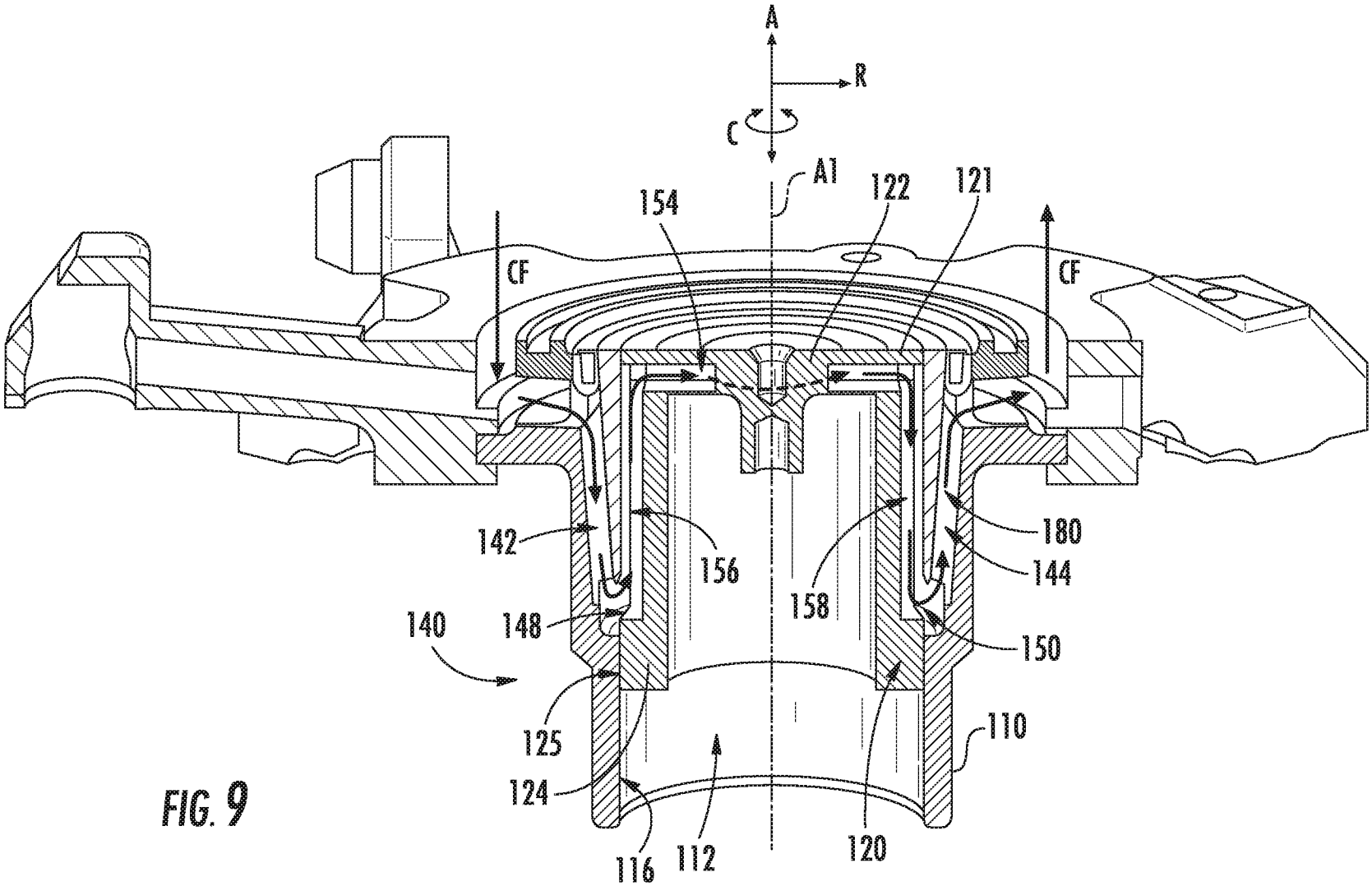
FIGS. 9 and 10 provide perspective, cross sectional views of the piston of FIGS. 6 through 8 slidably received within the chamber of the casing according to an example embodiment of the present subject matter.
Figure 10:
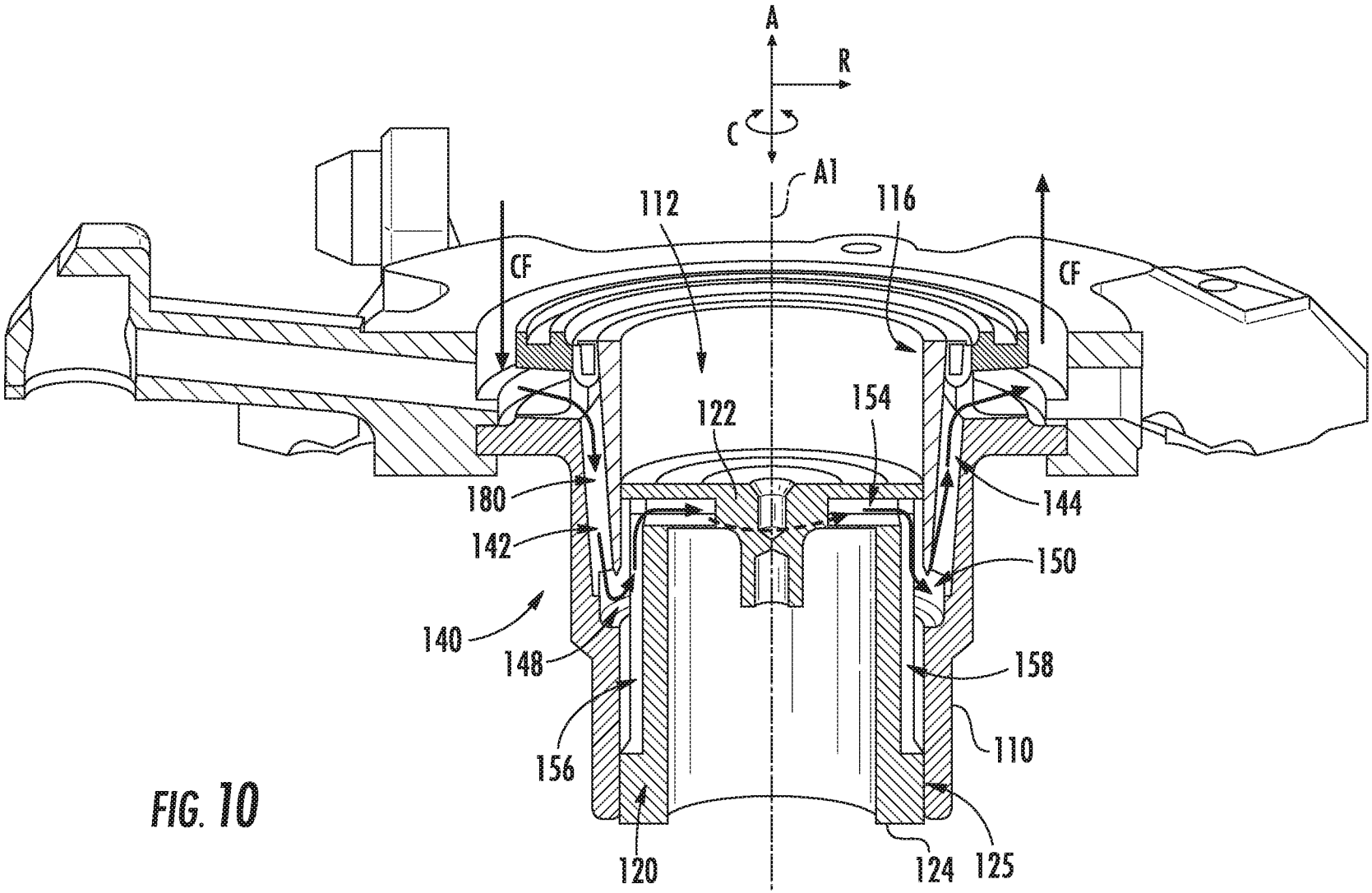

FIGS. 9 and 10 provide perspective, cross sectional views of piston 120 of FIGS. 6 through 8 slidably received within chamber 112 of casing 110 according to an example embodiment of the present subject matter. In FIG. 9, piston 120 is shown in the top dead center position. In FIG. 10, piston 120 is shown in the bottom dead center position. An exemplary manner in which heat generated during the compression process may be removed from casing 110 and piston 120 by heat exchanger 140 (FIG. 4) will now be described.

With general reference to FIGS. 9 and 10, cooling fluid CF (e.g., refrigerant, oil, etc.) may flow from cooling fluid circuit 80 (FIG. 2) into inlet passage 142 defined by casing 110 as shown in FIGS. 9 and 10. The cooling fluid CF extracts heat from the relatively hot walls of casing 110 as the cooling fluid CF passes through inlet passage 142. In some embodiments, such as the embodiment shown in FIGS. 9 and 10, the cooling fluid CF may flow annularly around chamber 112 via an annular casing channel 180. Annular casing channel 180 fluidly connects inlet passage 142 and outlet passage 144 and is integral therewith. As the cooling fluid CF passes through annular casing channel 180, the cooling fluid CF may extract heat from the relatively hot walls of casing 110. Some amount of cooling fluid CF flows from inlet passage 142 into inlet groove 156 defined along or recessed within outer surface 125 of piston 120. As noted above, outlet 148 of inlet passage 142 is fluidly connected with inlet groove 156 of piston 120 regardless of the axial position of piston 120 within chamber 112. The cooling fluid CF flows into inlet groove 156 and extracts heat from skirt 124 of piston 120 and inner surface 116 of casing 110 as piston 120 reciprocates within chamber 112. The cooling fluid CF continues downstream into cooling channel 154 defined by piston head 122 of piston 120. The cooling fluid CF flows generally circumferentially through cooling channel 154 and extracts heat from the various walls of piston head 122. Importantly, the cooling fluid CF extracts heat from first wall 121 piston head 122, which is the lead wall of piston 120 that interacts with the gaseous refrigerant within chamber 112. In some embodiments, cooling channel 154 defined by piston head 122 is radially and circumferentially aligned (at least in part) with discharge valve 132 (FIG. 3) for improved cooling of the area of piston 120 that forces compressed gaseous refrigerant into discharge conduit 134 (FIG. 3) through discharge valve 132.

The cooling fluid CF exits cooling channel 154 defined by piston head 122 and flows downstream into outlet groove 158. The cooling fluid CF extracts heat from skirt 124 of piston 120 and inner surface 116 of casing 110 as piston 120 reciprocates within chamber 112. The cooling fluid CF continues downstream and enters outlet passage 144 through inlet 150 of outlet passage 144. As noted above, inlet 150 of outlet passage 144 is fluidly connected with outlet groove 158 regardless of the axial position of piston 120 within chamber 112. The cooling fluid CF flowing from outlet groove 158 through inlet 150 may mix with the cooling fluid flowing annularly around chamber 112 through annular casing channel 180. The mixed cooling fluid CF returns to cooling fluid circuit 80 (FIG. 2). For instance, the cooling fluid CF may return directly to a main conduit of refrigeration system 60 (FIG. 2) upstream of condenser 66 (FIG. 2) and downstream of the compressor 100 (FIG. 2), or alternatively, the cooling fluid may be directed to discharge conduit 134 (as shown by the dotted lines in FIG. 3) where the cooling fluid CF may mix with the compressed gaseous refrigerant exiting linear compressor 100 through hermetic shell 104.

Extracting heat generated during the compression process in the manner described above provides a number of advantages and benefits. For instance, the removal or extraction of heat from casing 110 and piston 120 reduces the discharge temperature of the gaseous refrigerant or oil compressed within the chamber. Further, the removal of heat moves the compression process toward a more isothermal process, and consequently, this reduces the thermodynamic work required for compression. Additional advantages and benefits not specifically listed may be realized or achieved.

In some embodiments, with reference to FIGS. 2 and 3, the flow rate of the cooling fluid CF through heat exchanger 140 may be controlled to remove heat from casing 110 and piston 120 whilst accommodating the cooling needs of compartments 14, 18. In such embodiments, controller 90 is configured to receive one or more signals indicative of the temperature of the cooling fluid CF at an outlet of linear compressor 100 or a position downstream of the outlet of linear compressor 100 and upstream of condenser 66. For instance, the signals may be indicative of the temperature of the cooling fluid CF within outlet passage 144 (FIG. 4). For instance, controller 90 may receive the one or more signals from temperature sensor 86. Further, in some embodiments, controller 90 is configured to receive one or more compartment temperature signals indicative of the temperature of the air within one or more compartments 14, 18 of refrigerator appliance 10. Controller 90 may receive the one or more compartment temperature signals from compartment temperature sensor 88, for example.

In addition, controller 90 is configured to determine a first flow rate for delivering the cooling fluid to piston 120 and casing 110 based at least in part on the one or more signals received from temperature sensor 86 and the one or more compartment temperature signals received from compartment temperature sensor 88. Moreover, controller 90 is configured to control fluid control device 82 to selectively control the flow rate of the cooling fluid through piston 120 and casing 110 at the first flow rate. In this way, the volume or amount of refrigerant delivered to heat exchanger 140 may be controlled, and consequently, the amount of cooling provided to piston 120 and casing 110 whilst ensuring that the temperature needs of compartments 14 and 18 are met.

Figure 11:
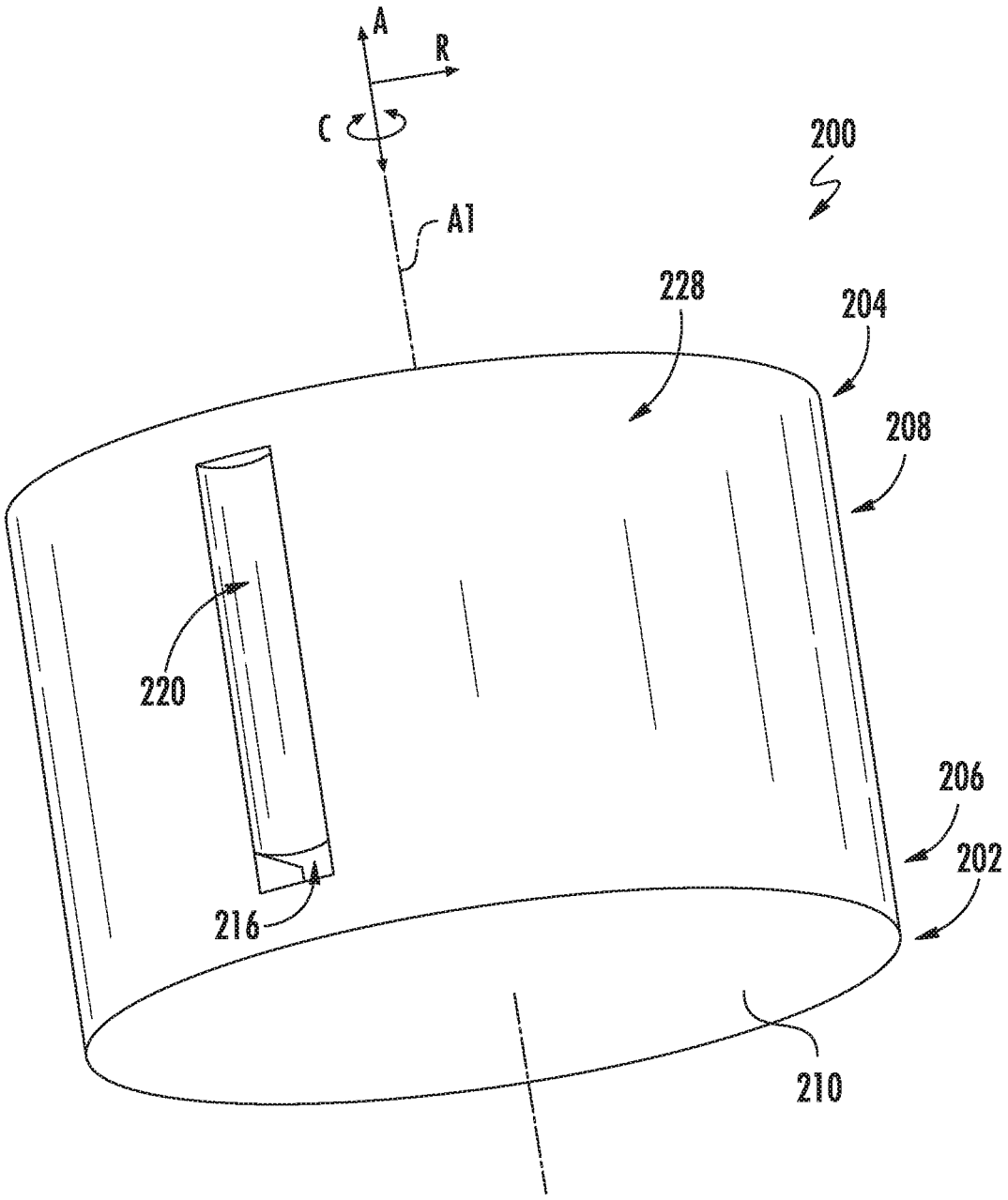
FIGS. 11 through 13 provide various perspective views of another example piston according to an example embodiment of the present subject matter.
Figure 12:
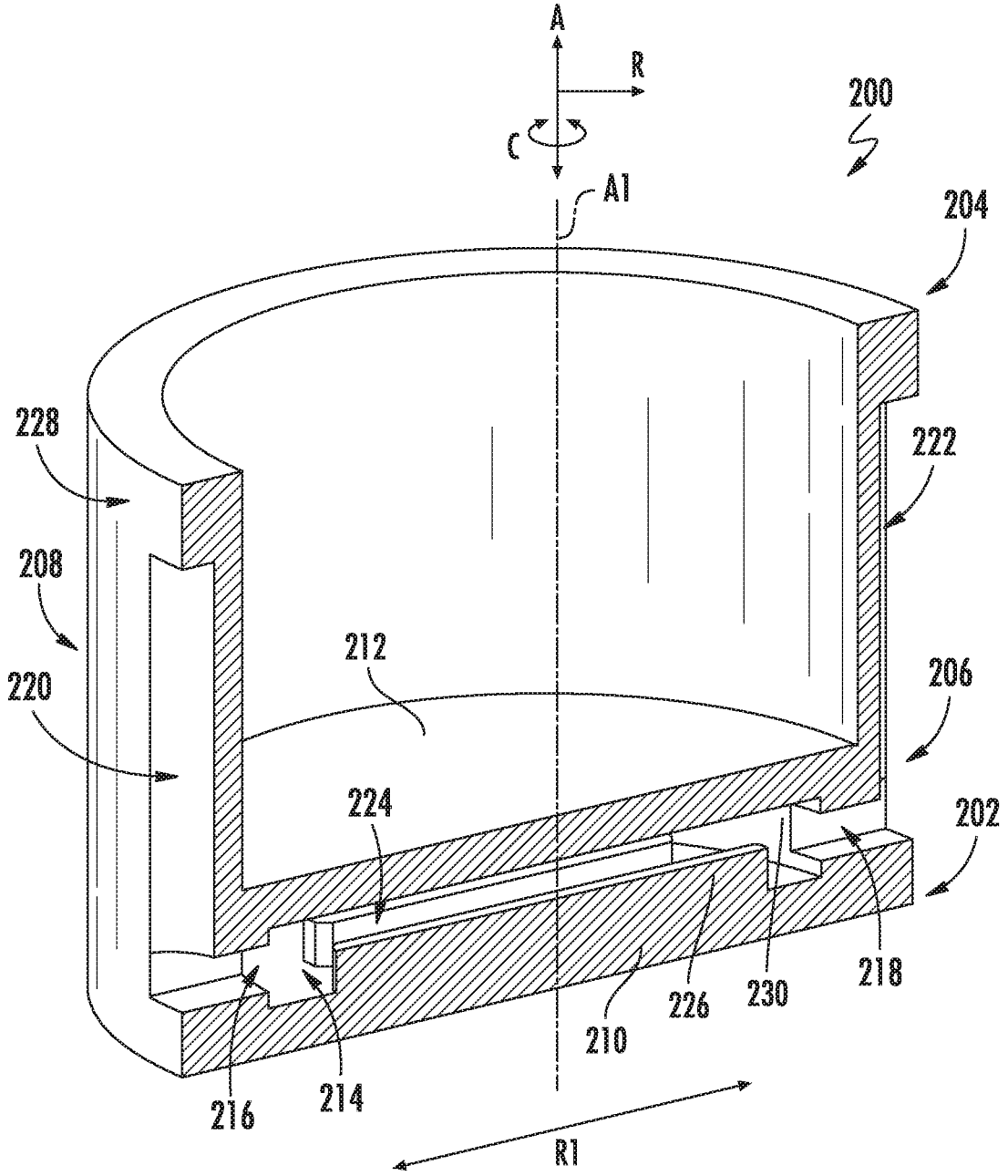
Figure 13:
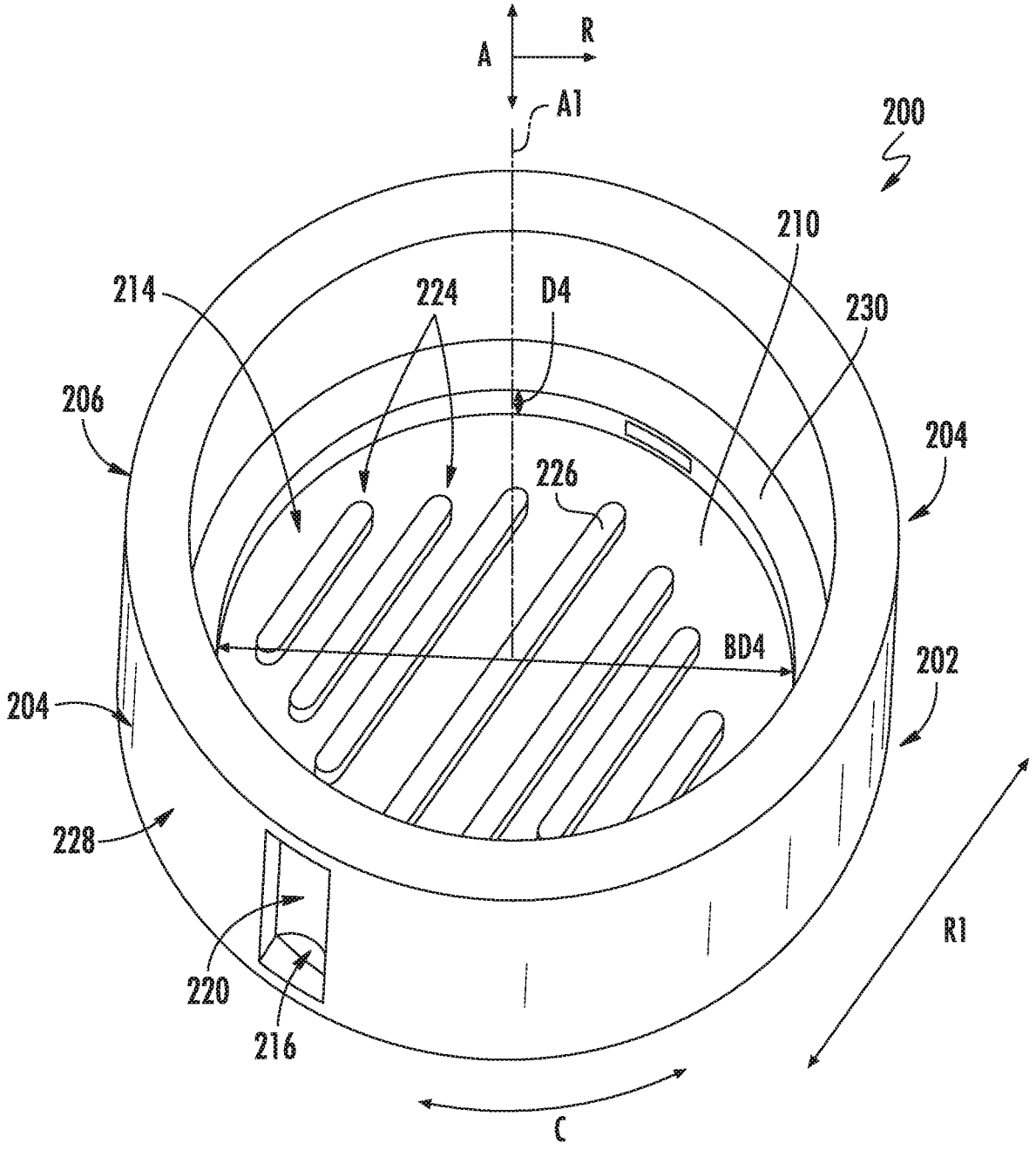

FIGS. 11, 12, and 13 provide various views of another example piston 200 according to an example embodiment of the present subject matter. In particular, FIG. 11 provides a perspective view of piston 200. FIG. 12 provides a perspective, cross-sectional view of piston 200. FIG. 13 provides a perspective view of piston 200 with a second wall 212 of a piston head 206 of piston 200 removed for illustrative purposes. Piston 200 of FIGS. 11 through 13 may be employed with the compression assemblies and systems described herein, such as linear compressor 100 illustrated in FIG. 3. As shown, piston 200 extends between a first end 202 and a second end 204 along the axial direction A. Piston 200 has piston head 206 positioned generally at first end 202 and a skirt 208 extending from piston head 206 to second end 204 of piston 200, e.g., longitudinally along the axial direction A. During sliding of piston 200 within a chamber, piston 200 may compress a refrigerant or fuel source.

As best shown in FIGS. 12 and 13, piston 200 defines a cooling channel 214, an inlet groove 220, and an outlet groove 222. More particularly, piston head 206 defines cooling channel 214, and inlet groove 220 and outlet groove 222 are defined by piston 200 along an outer surface 228 of piston 200. Inlet groove 220 and outlet groove 222 are spaced from one another, e.g., along the circumferential direction C, and both extend longitudinally along the axial direction A. For this embodiment, inlet groove 220 is defined radially opposite of outlet groove 222 (i.e., inlet groove 220 is spaced from outlet groove 222 one hundred eighty degrees (180°) along the circumferential direction C). Consequently, an inlet 216 of cooling channel 214 is positioned radially opposite an outlet 218 of cooling channel 214. A first radial direction R1 extends between inlet 216 and outlet 218 of cooling channel 214 for reference.

Inlet groove 220 is defined axially along at least a portion of piston head 206 and along at least a portion of skirt 208 at outer surface 228 of piston 200. Similarly, outlet groove 222 is defined axially along at least a portion of piston head 206 and along at least a portion of skirt 208 at outer surface 228 of piston 200. Inlet groove 220 of piston 200 may fluidly connect an inlet passage of casing (not shown in this embodiment) with cooling channel 214 of piston 200. Outlet groove 222 of piston 200 may fluidly connect cooling channel 214 of piston 200 with an outlet passage of casing (not shown in this embodiment). Accordingly, cooling fluid (e.g., refrigerant, oil, etc.) may flow through the inlet passage of the casing and into inlet groove 220 of piston 200, through cooling channel 214 of piston head 206, along outlet groove 222, and may flow through the outlet passage of the casing where the cooling fluid may return to a cooling fluid circuit (not shown in this embodiment). In this manner, heat generated during the compression process is removed from the casing and piston disposed within a chamber of the casing. Accordingly, the discharge temperature of the gaseous refrigerant or oil compressed within the chamber may be reduced and a more isothermal process may be achieved, which reduces the thermodynamic work of the compression assembly.

Cooling channel 214 is defined by piston head 206 such that it forms a generally cylindrical cavity. Particularly, cooling channel 214 has a depth D4 (FIG. 13) that extends between a first wall 210 and second wall 212 (FIG. 12; removed in FIG. 13) of piston head 206, e.g., along the axial direction A. The depth D4 forms the axial height or length of the cylindrical cavity of cooling channel 214. Cooling channel 214 has a base diameter BD4 (FIG. 13) that extends between opposing sides of an inner rim 230 of piston 200. As shown, the base diameter BD4 extends substantially all of the radial length or diameter of piston 200, e.g., more than about ninety percent (90%) of the radial length of piston 200. Accordingly, the majority of first wall 210, the wall that interacts with the hot gaseous refrigerant or oil being compressed by piston 200 within the chamber, may be cooled by cooling fluid. Particularly, about ninety percent (90%) or more of first wall 210 may be cooled by cooling fluid in the embodiment of FIGS. 11 through 13.

Further, as shown best in FIGS. 12 and 13, a plurality of fins 224 project from first wall 210 along the axial direction A into cooling channel 214. Generally, fins 224 increase the surface area in which the cooling fluid may contact and thus fins 224 increase the heat transfer between piston 200 and the cooling fluid. For this embodiment, fins 224 extend longitudinally along the first radial direction R1 and are spaced from one another along a direction perpendicular to the first radial direction R1. A first fin 226 of fins 224 radially aligned with inlet 216 and outlet 218 has the longest radial length of fins 224 (e.g., along the first radial direction R1). The radial length of each successive fin 224 extending outward from first fin 226 along a direction perpendicular to the first radial direction R1 decreases. For this embodiment, fins 224 project from first wall 210 into cooling channel 214 a distance that is less than the depth D4. However, in alternative embodiments, fins 224 may extend between first wall 210 and second wall 212. In some embodiments, piston 200 may be additively manufactured, e.g., via a 3D printing process. In this manner, fins 224 and the surfaces of piston 200 defining cooling channel 214 may be printed having various shapes and surface finishes, such as e.g., porous or rough surfaces.

Figure 14:
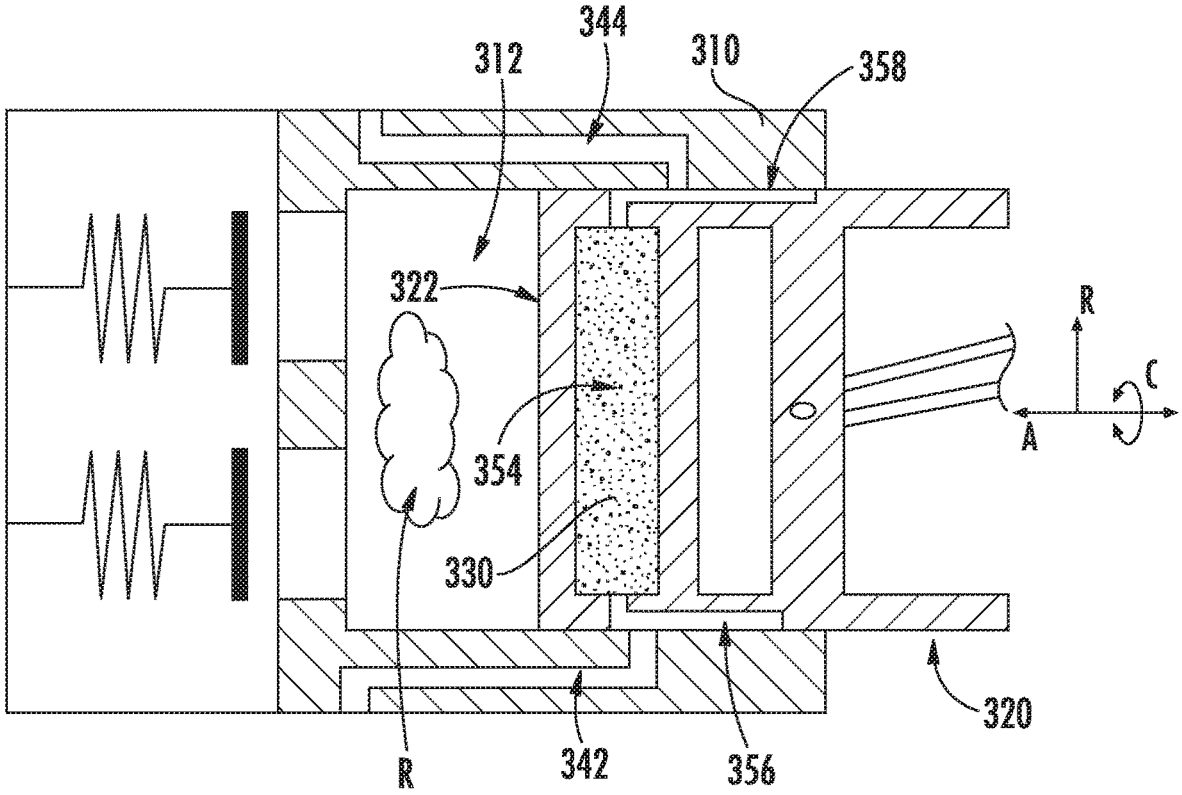
FIG. 14 provides a close up, schematic view of a piston slidably received within a chamber of a casing of an example compression assembly according to an example embodiment of the present subject matter.

FIG. 14 provides a close up, schematic view of a piston 320 slidably received within a chamber 312 of a casing 310 of a compression assembly 300 according to an example embodiment of the present subject matter. Casing 310 and piston 320 of compression assembly 300 of FIG. 14 are similarly configured to the casing 110 and piston 120 of the linear compressor 100 of FIG. 4 except as provided below. As shown in FIG. 14, one or more passages, grooves, or channels may contain or receive a metallic foam component 330. Particularly, for the embodiment of FIG. 13, metallic foam component 330 is disposed within cooling channel 354 defined by piston head 322 of piston 320. For this embodiment, metallic foam component 330 fills substantially all of the volume of cooling channel 354. Although not show, in some alternative exemplary embodiments, metallic foam components 330 may be positioned within inlet passage 342 and/or outlet passage 344. In yet other embodiments, metallic foam components 330 may be positioned within inlet groove 356 and/or outlet groove 358.

Generally, the metallic foam component 330 may facilitate removal of the heat generated during the compression process by facilitating the transfer of heat to the cooling fluid CF. Particularly, the metallic foam component 330 increases the surface area in which the cooling fluid CF may contact and thus the metallic foam component 330 may increase the heat transfer between the piston 320/casing 310 and the cooling fluid CF. Metallic foam component 330 may cause the cooling fluid CF flowing through heat exchanger 140 to exhibit a more turbulent flow, which ultimately facilitates heat transfer to the cooling fluid CF. The metallic foam component 330 may have a cellular structure formed of metal with a plurality of pores.

Figure 15:
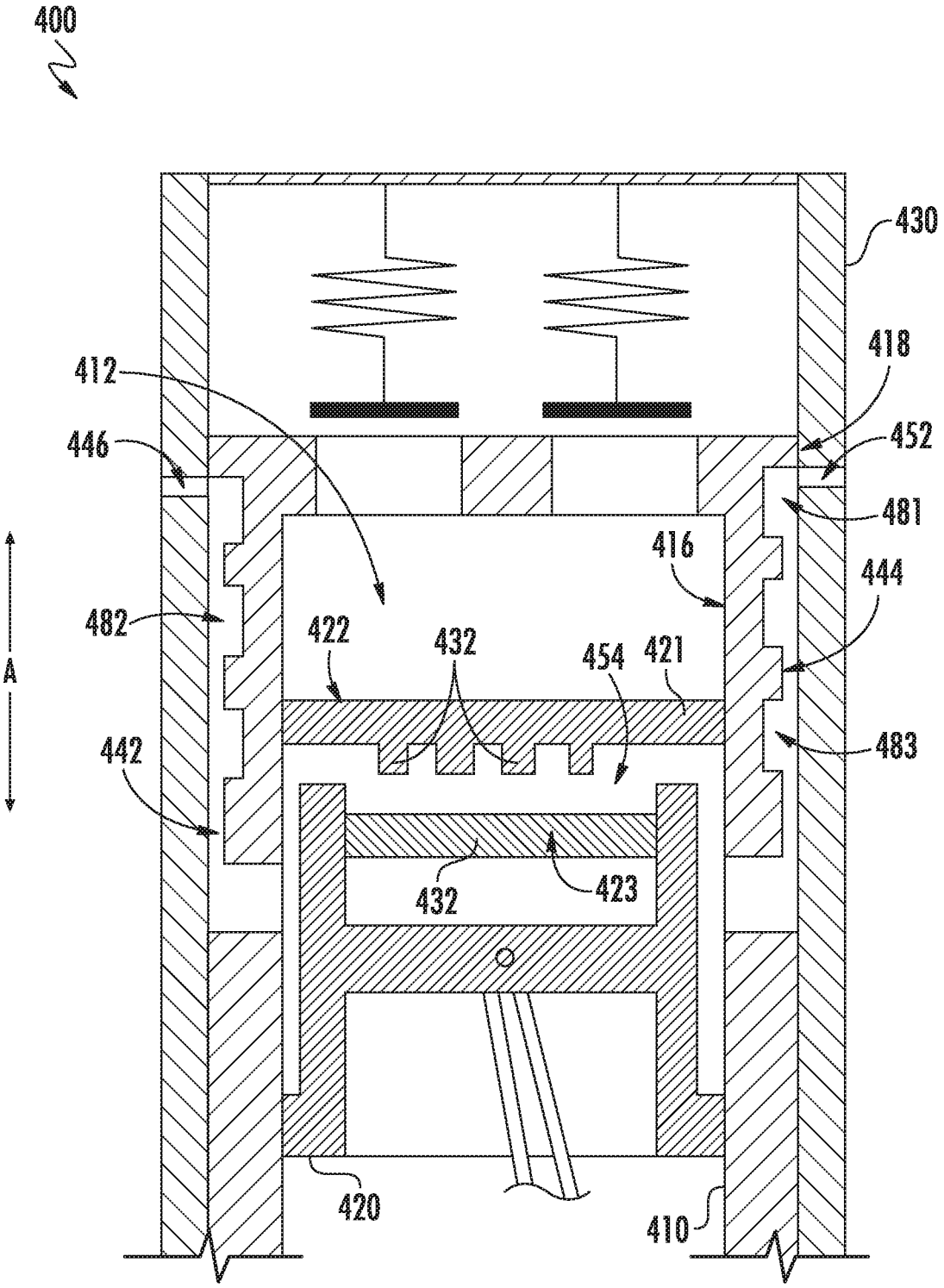
FIG. 15 provides a schematic cross-sectional view of a piston slidably received within a chamber of a casing of an example compression assembly according to an example embodiment of the present subject matter.

FIG. 15 provides a schematic cross-sectional view of a piston 420 slidably received within a chamber 412 of a casing 410 of an example compression assembly 400 according to an example embodiment of the present subject matter. Casing 410 and piston 420 of compression assembly 400 of FIG. 15 are similarly configured to the casing 110 and piston 120 of the linear compressor 100 of FIG. 4 except as provided below.

As shown in FIG. 15, casing 410 defines a plurality of casing channels, including a first casing channel 481, a second casing channel 482, and third casing channel 483. The casing channels 481, 482, 483 are spaced from one another along the axial direction A and each extend annularly about chamber 412 of casing 410. Further, the casing channels 481, 482, 483 are each fluidly connected by inlet passage 442 and outlet passage 444 at radially opposite positions. Notably, inlet passage 442, outlet passage 444, and casing channels 481, 482, 483 are defined by casing 110 at an outer surface 418 of casing 410. Outer surface 418 is radially spaced from inner surface 416 of casing 410 that defines chamber 412. As the inlet passage 442, outlet passage 444, and casing channels 481, 482, 483 are defined at outer surface 418 of casing 410, machining of such passages and casing channels is made easier. To enclose the passages and casing channels, a casing cap 430 is attached to or fit over casing 410 as shown in FIG. 15. Casing cap 430 may define a first radial hole to define an inlet 446 of inlet passage 442 and a second radial hole to define an outlet 452 of outlet passage 444.

Further, as depicted in FIG. 15, a plurality of fins 434 may be machined into first wall 421 of piston head 422 and cooling channel 454 may be defined. Thereafter, a piston cap 432 may be attached to or otherwise connected to piston 420 such that it forms second wall 423 of piston head 422 and encloses cooling channel 454. With such an arrangement, the ease of manufacturing piston 420 is improved.

Figure 16:
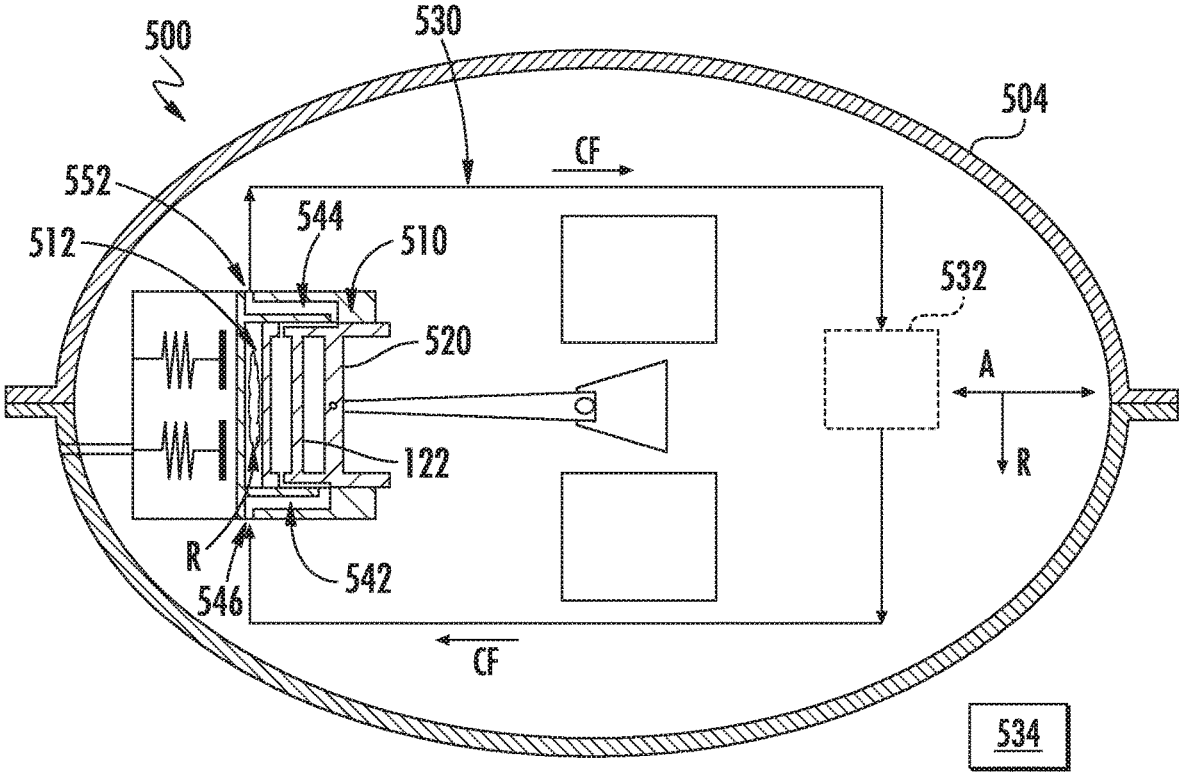
FIG. 16 provides a schematic view of another linear compressor according to an example embodiment of the present subject matter.

FIG. 16 provides a schematic view of another linear compressor 500 according to an example embodiment of the present subject matter. The linear compressor 500 of FIG. 16 is similarly configured to the linear compressor 100 of FIG. 3 except as provided below.

For the depicted embodiment of FIG. 16, the cooling fluid circuit 530 is a closed loop circuit and is configured to receive a cooling fluid CF, e.g., oil. Cooling fluid circuit 530 is completely enclosed or entirely encased within hermetic shell 504, and accordingly, any leakage of cooling fluid CF from cooling fluid circuit 530 is contained within hermetic shell 504. Cooling fluid circuit 530 may include a tube or conduit that is fluidly connected with inlet 546 of inlet passage 542 of casing 510 at one end and outlet 552 of outlet passage 544 at its other end. In some embodiments, the cooling fluid CF circulates through cooling fluid circuit 530 by reciprocation of piston 520 within chamber 512 of casing 510. Cooling fluid CF may be driven through cooling fluid circuit 530 such that heat is removed or extracted from the relatively hot surfaces and walls of casing 510 and piston 520. In some embodiments, advantageously, cooling fluid circuit 530 is kept at the same elevation, e.g., along the axial direction A. Further, for the depicted embodiment of FIG. 16, no refrigerant from the vapor compression cycle need be routed to heat exchanger 540 of the compressor 500.

Further, in some exemplary embodiments, a circulation device 532 is optionally positioned along cooling fluid circuit 530, e.g., to circulate or drive cooling fluid CF through cooling fluid circuit 530. As one example, circulation device 532 may be a pump. For instance, the pump may be a pump positioned in an oil sump of linear compressor 500. In some embodiments, a controller 534 is communicatively coupled with circulation device 532, e.g., via a suitable wired or wireless communication link. Controller 534 is operable to control circulation device 532. For instance, controller 534 may control circulation device 532 to increase or decrease the flow rate of the cooling fluid CF within cooling fluid circuit 530, e.g., based on one or more temperature signals from a temperature sensor. Controller 534 may be similarly configured as controller 90 of FIG. 2.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system, comprising:

a cooling fluid circuit configured to receive a cooling fluid;

a compression assembly, comprising:

a casing defining a chamber, an inlet passage, and an outlet passage, the inlet passage in fluid communication with the cooling fluid circuit and configured to receive the cooling fluid, the outlet passage in fluid communication with the cooling fluid circuit and configured to return the cooling fluid to the cooling fluid circuit;

a piston slidably received within the chamber of the casing, the piston having a piston head and an outer surface, the piston head defining a cooling channel and the piston defining an inlet groove and an outlet groove along the outer surface of the piston, wherein the inlet groove of the piston fluidly connects the inlet passage of the casing with the cooling channel of the piston, and wherein the outlet groove of the piston fluidly connects the cooling channel of the piston with the outlet passage of the casing, wherein the piston is slidable between a top dead center position and a bottom dead center position within the chamber of the casing, and wherein the inlet groove of the piston fluidly connects the inlet passage of the casing with the cooling channel of the piston at both the top dead center position and the bottom dead center position, and wherein the outlet groove of the piston fluidly connects the cooling channel of the piston with the outlet passage of the casing at both the top dead center position and the bottom dead center position.

2. The system of claim 1, wherein a stroke of the piston is defined between the top dead center position and the bottom dead center position, and wherein the inlet passage of the casing has an outlet and the outlet passage of the casing has an inlet, and wherein the outlet of the inlet passage is axially and radially aligned with at least a portion of the inlet groove of the piston and the inlet of the outlet passage is axially and radially aligned with at least a portion of the outlet groove of the piston through the stroke of the piston.

3. The system of claim 1, wherein the piston head defines a plurality of fins projecting into the cooling channel.

4. The system of claim 1, wherein the casing defines one or more casing channels fluidly connecting the inlet passage with the outlet passage of the casing.

5. The system of claim 4, wherein at least one of the one or more casing channels extends annularly around the casing to fluidly connect the inlet passage with the outlet passage.

6. The system of claim 1, wherein the compression assembly defines an axial direction, a radial direction, and a circumferential direction, and wherein the piston is slidable along a first axis that extends along the axial direction, and wherein the cooling channel of the piston head extends along the circumferential direction around the first axis equal to or more than one hundred eighty degrees (180°).

7. The system of claim 1, wherein the compression assembly defines an axial direction, a radial direction, and a circumferential direction, and wherein the piston has a skirt having an axial length, and wherein the inlet groove and the outlet groove extend along the axial direction at least half the axial length of the skirt.

8. The system of claim 1, wherein the compression assembly defines an axial direction, a radial direction, and a circumferential direction, and wherein the chamber of the casing has an axial length that extends between a first end and a second end along the axial direction, and wherein the inlet passage and the outlet passage of the casing extend a distance that is at least half of the axial length of the chamber along the axial direction.

9. The system of claim 1, wherein the compression assembly defines an axial direction, a radial direction, and a circumferential direction, and wherein the chamber extends between a first end and a second end along the axial direction, and wherein the inlet passage and the outlet passage of the casing each extend along the axial direction from at least the first end of the chamber to an axial position that is further toward the second end of the chamber than a first surface of the piston head along the axial direction.

10. The system of claim 1, further comprising:

a temperature sensor operable to sense an outlet temperature of the cooling fluid at the outlet passage of the casing;

a fluid control device operable to selectively control a flow rate of the cooling fluid through the casing and the piston; and a controller communicatively coupled with the temperature sensor and the fluid control device, the controller configured to:

receive one or more signals indicative of the outlet temperature of the cooling fluid at the outlet passage of the casing;

determine a first flow rate for cooling the casing and the piston based at least in part on the one or more signals; and control the fluid control device to selectively control the flow rate of the cooling fluid through the casing and the piston at the first flow rate.

11. The system of claim 1, wherein the cooling channel defined by the piston head extends between an outer wall of the piston and a center hub of the piston.

12. The system of claim 1, further comprising:

a hermetic shell, wherein the compression assembly and the cooling fluid circuit are entirely encased within the hermetic shell.

13. The system of claim 1, wherein the cooling fluid is a refrigerant.

14. A compression assembly defining an axial direction, a radial direction, and a circumferential direction, the compression assembly comprising:

a casing defining a chamber, an inlet passage, and an outlet passage, the inlet passage configured to receive a cooling fluid from a cooling fluid circuit and the outlet passage configured to return the cooling fluid to the cooling fluid circuit; and a piston slidably received within the chamber of the casing along the axial direction and movable between a top dead center position and a bottom dead center position to define a stroke of the piston, the piston having a piston head and an outer surface, the piston head defining a cooling channel, the piston defining an inlet groove extending longitudinally along the axial direction at the outer surface of the piston and an outlet groove extending longitudinally along the axial direction at the outer surface of the piston, the inlet groove spaced from the outlet groove along the circumferential direction, and wherein the inlet groove of the piston fluidly connects the inlet passage of the casing with the cooling channel of the piston through the stroke of the piston, and wherein the outlet groove of the piston fluidly connects the cooling channel of the piston with the outlet passage of the casing through the stroke of the piston.

15. The compression assembly of claim 14, wherein the compression assembly is a linear compressor of an appliance.

16. The compression assembly of claim 14, wherein the casing has an outer surface and an inner surface radially spaced from the outer surface, and wherein the casing defines one or more casing channels along the outer surface, and wherein the one or more casing channels are fluidly connected with at least one of the inlet passage and the outlet passage, and wherein the compression assembly further comprises:

a casing cap attached to or fit over the casing such that the one or more casing channels are enclosed.

17. The compression assembly of claim 14, wherein the piston head of the piston has a first wall at least partially defining the cooling channel, and wherein the compression assembly further comprises:

a piston cap attached to the piston head and positioned such that the piston cap is radially spaced from the first wall and forms a second wall of the piston head to enclose the cooling channel.

18. The compression assembly of claim 14, further comprising:

a metallic foam component disposed in at least one of the cooling channel, the inlet passage, and the outlet passage.

* * * * *